US009877621B2

(12) United States Patent
Schottenstein

(10) Patent No.: US 9,877,621 B2
(45) Date of Patent: Jan. 30, 2018

(54) COLLAPSIBLE TOILET SEATING ASSEMBLY

(71) Applicant: Albi Design I LLC, Los Angeles, CA (US)

(72) Inventor: Aryeh Leib Schottenstein, Los Angeles, CA (US)

( * ) Notice: Subject to any disclaimer, the term of this patent is extended or adjusted under 35 U.S.C. 154(b) by 0 days.

(21) Appl. No.: 14/973,587

(22) Filed: Dec. 17, 2015

(65) Prior Publication Data

US 2017/0172360 A1 Jun. 22, 2017

(51) Int. Cl.
*A47K 13/00* (2006.01)

(52) U.S. Cl.
CPC ..... *A47K 13/005* (2013.01)

(58) Field of Classification Search
CPC ..... A47K 13/05
USPC ..... 4/239, 479–480
See application file for complete search history.

(56) References Cited

U.S. PATENT DOCUMENTS

| | | | | |
|---|---|---|---|---|
| 857,914 A | | 6/1907 | Weber | |
| 905,496 A | | 12/1908 | Cameron | |
| 1,391,791 A | | 9/1921 | Rathjen | |
| 1,410,427 A | * | 3/1922 | Turnquist | A47K 13/06 4/239 |
| 1,428,627 A | | 9/1922 | Grabfelder | |
| 1,482,073 A | | 1/1924 | Ferdinand | |
| 1,492,798 A | * | 5/1924 | Houston | A47K 13/06 4/239 |
| 2,473,090 A | | 6/1949 | Becker | |
| 2,742,650 A | * | 4/1956 | Meade | A47K 13/00 4/239 |
| 3,829,908 A | * | 8/1974 | Thomas | A47K 11/04 135/75 |
| 6,247,749 B1 | | 6/2001 | Yu | |
| 6,842,919 B2 | * | 1/2005 | Wilson | A47K 3/282 297/180.15 |
| 6,969,112 B1 | | 11/2005 | Sherrill | |
| 6,986,173 B1 | | 1/2006 | Hickey | |
| 7,962,973 B2 | | 6/2011 | Sikirov | |
| 8,051,504 B1 | * | 11/2011 | Folds | A47K 13/005 4/239 |

(Continued)

FOREIGN PATENT DOCUMENTS

| | | |
|---|---|---|
| DE | 20209191 | 10/2002 |
| JP | 2002200006 | 7/2002 |

OTHER PUBLICATIONS

"Pico Arm Chair", Retrieved from the Internet Dec. 17, 2015, URL<https://www.gcioutdoor.com/directors-chairs/pico-arm-chair.htm>.

(Continued)

*Primary Examiner* — Christine Skubinna
(74) *Attorney, Agent, or Firm* — Brooks Acordia IP Law, P.C.; Douglas N. Larson

(57) ABSTRACT

A collapsible seating assembly including a bi-directionally expandable support frame, a carrying handle, a collapsible backrest/shield, height-adjustable legs, and a collapsible seating surface. The seating surface can make available via a through-opening an underlying toilet bowl, a toilet opening or a collection bag. Components of the assembly are collapsible and expandable such that the assembly can be converted by a user between a compact transportable mode and an expanded deployed mode.

59 Claims, 23 Drawing Sheets

(56) References Cited

U.S. PATENT DOCUMENTS

| | | | | |
|---|---|---|---|---|
| 2007/0296259 | A1* | 12/2007 | Birk | A47C 1/025 297/366 |
| 2009/0094733 | A1* | 4/2009 | Diamond | A47K 11/04 4/483 |
| 2010/0050333 | A1* | 3/2010 | Jenkins | A47K 11/04 4/483 |
| 2010/0243011 | A1* | 9/2010 | Lin | A47K 11/04 135/66 |
| 2010/0301639 | A1* | 12/2010 | McPheeters | A61G 9/003 297/118 |
| 2014/0013496 | A1* | 1/2014 | Blair | A47K 13/28 4/239 |
| 2014/0359930 | A1* | 12/2014 | Chlapaty | E04H 4/14 4/496 |

OTHER PUBLICATIONS

"Commode Chair", Retrieved from the Internet Dec. 17, 2015, URL<http://www.caregiver-aid.com/products-page/3-in-1-steel-folding-commode/>.

"Folding Steel Bedside Non-Electric Waterless Toilet", Retrieved from the Internet Dec. 17, 2015, URL<http://www.homedepot.com/p/Medline-Folding-Steel-Bedside-Non-Electric-Waterless-Toilet-MDS89664FR/204788989?cm_mmc=Shopping%7cTHD%7cG%7c0%7cG-BASE-PLA-D29B-Fixtures&Toilets%7c&gclid=CNy2xYnj3MkCFUWVfgodzlcM9A&gclsrc=aw.ds>.

"Western Patient Raised Toilet Seat Folding Comod Chair", Retrieved from the Internet Dec. 17, 2015, URL<http://www.alibaba.com/product-detail/westem-patient-raised-toilet-seat-folding_60278687027.html>.

"Throne", Retrieved from the Internet Dec. 17, 2015, URL<http://www.ticatoca.com/view.php?product=1059>.

"Reliance Fold-to-Go Portable Toilet", Retrieved from the Internet Dec. 17, 2015, URL<http://www.amazon.com/Reliance-Products-Collapsible-Portable-Toilet/dp/B0024OAQ3Q/ref=sr_1_1?ie=bUTF8&qid=1450144344&sr=8-1&keywords=reliance+fold-to-go+toilet>.

International Search Report for Serial No. PCT/US16/67346 dated Apr. 20, 2017.

* cited by examiner 100
130
160
161
150
110
180
162
181
140
163
120
170
190
178

COLLAPSIBLE TOILET SEATING ASSEMBLY

BACKGROUND

Restrooms, both public and private, vary greatly in their spatial layout, toilet type, and degree of cleanliness. A sanitary toilet is not always conveniently available and the options for quickly making such a toilet suitable for use are few, and often require a user come into contact with dirty toilet hardware and/or surrounding areas. Paper toilet seat covers are generally ineffective since they are porous and do not act as a barrier to bacteria or dampness.

SUMMARY

According to an aspect of the present disclosure provided herein is a seating assembly that can be quickly and easily converted by a user between a compact transportable mode wherein it may be suitable for sanitary, discreet and easy transport and a deployed expanded mode wherein it may be easily adjusted so as to be compatible for use over any number of toilet types, or as a toilet-like seating solution in the absence of an actual underlying toilet.

According to one aspect of the disclosure provided herein is a seating assembly that includes: a rectangular, telescopically-expandable frame; four independently telescoping, lockable legs; a paneled, expandable, unfoldable seating surface with a generally circular/round opening; and a carrying handle which may be expanded upward to form a backrest/shield. Longitudinal support bars of the frame are attached to the lateral support bars (via a loop fixture or eyelet, for example) so that the lateral bars move through the loops when expanded, thereby allowing the backmost and foremost lateral supports to be expanded independently of one another. Due to this configuration, the longitudinal support bars are expanded in tandem (or pursuant to an alternative embodiment independently of one another). Furthermore, the telescoping legs can be attached to the frame via respective hinges so that they can be folded up to be flush with/parallel to the plane of the frame (while in a transportable mode, for example) and then rotated or pivoted down to be perpendicular to the frame in order to be deployed and serve as the supporting legs of the assembly. The legs can lock or "snap" into their perpendicular positions via a "spring-loaded pin and opening" fixture (or similar) or by a friction hinge, and released to be pivoted to their compact mode via the same fixture. The carrying handle can be pivotally attached to the backmost lateral support bar of the frame, allowing it to be positioned parallel with the plane of the frame or pivoted so as to be perpendicular to the frame/seating surface when in an expanded mode.

According to another aspect of the disclosure provided herein is a transportable chair assembly that includes a fold-out seating surface that includes a series of generally rectangular panels sealed, for example, within a plastic or rubber-like material. This construction allows for the plastic or rubber-like material to form "seams" between each panel so that they can be folded up/stacked (to minimize surface area when the chair assembly is in a transportable mode) while still being connected as a "single piece," then unfolded to form a larger, surface area for seating use. When unfolded, half of these panels can form the left side of a seating surface, and the other half can form the right side seating surface; thereby each panel side is half the width of the total seating surface). These two "sides" of panels can be connected via a single longitudinal "seam."

Each "side" set of panels can unfold longitudinally down the length of the toilet area, with these panels being attached to one another via lateral seams. When in the compact, transportable mode, the folded seat is as wide as a single panel (half the width of the expanded seating surface), as long as a single panel, and as tall (thick) as all the panels stacked together. The panels can be connected to the frame by hook fixtures that allow them to snap onto and rest on the support bars of the frame and to be easily removed for cleaning. Once the frame is expanded to its desired size, the folded seat can be unfolded. A user can first unfold the seating surface laterally, thereby making it the full width, then unfold the panels down the length of the toilet so that they rest on the longitudinal support bars of the frame. Alternatively, the seating surface can be unfolded longitudinally and then laterally.

According to a further aspect of the disclosure the unfolding seating surface can include a sufficient number of panels so that the panels can be unfolded over the forwardmost lateral support bar. This additional length of unfolded seating surface can form a barrier between the user and the front side portion of the toilet that might otherwise come into contact with the user's legs and/or clothing.

According to a still further aspect of the disclosure provided herein are four independently-telescopically, height-adjustable support legs comprised of one outer section and two or three consecutively smaller inner sections, all of approximately the same height/length. The inner section can be quickly deployed and retracted via a spring-loaded button/release mechanism, such as might be found in a telescoping baton weapon (see, e.g., U.S. Pat. No. 6,231,447 (Pelkey)), entire contents incorporated herein by reference, or similar to that of a quick-release camera tripod. As such, when deployed, these inner sections form the legs. The (effective length of the) large outermost portion of the telescoping leg can be adjusted independently of the "quick deploy" spring-loaded inner sections via a pressure latch, which allows the inner sections to be expanded out from the largest outer section to a custom length (or not expanded out at all), then secured by closing the pressure latch.

As such, (each of) the legs can be set to any of the following four height configurations: (1) the length of one section (inner sections retracted, inner sections fully within the outer section); (2) the length of all sections (inner sections deployed, and fully extended from the outermost section); (3) the length of the outer section plus any length of the inner sections that extend beyond the outer section (inner sections deployed, but still not extended from the outer section); and (4) the length of the outer section plus a variable length of the inner sections (inner sections deployed, and extended to a custom (desired) length from within the outer section). With these options being fully functional and quickly set independently for each leg, a user is able to create a level seating surface compatible with generally any height or type of toilet. When deployed, the inner sections can securely lock into place, for example via a series of pins perpendicular to the axes of the legs. To retract, a spring-loaded mechanism releases the pins and allows the telescoping sections to collapse back into one another.

According to yet another aspect of the disclosure provided herein are leg caps, possibly weighted, at the foot of each support leg. These caps can be wider than the base of the bottommost (innermost) section of the telescoping support leg. They can have the same diameter as the outermost section of the support leg so that when the leg is fully collapsed, the cap appears to be an extension of the leg. The caps may also include a "tab," perpendicular to the leg and which allows a user to utilize her shoe or foot to assist in drawing the leg back into its retracted position. This tab can also function as a pressure latch to secure each of the telescoping sections and may be activated and deactivated by the user's hand or foot.

According to a still yet another aspect of the disclosure provided herein is a carrying handle assembly that can be converted into a backrest/shield. The handle can bridge two telescoping components that are attached to the backmost frame support via a hinge, for example. As such, the frame is pivoted below the handle when in the transportable mode, then rotated to be perpendicular to the handle when in the deployed mode. When the handle is pulled, the two telescoping supports expand, pulling/expanding along with them an accordion type of surface (made from plastic, for example), which forms a barrier/shield between the user and any toilet apparatus the user might be seated in front of while using the chair assembly. This shield may be comprised of three different sections, namely, a center section and two side sections pivotally attached to the side edges of the center section. Once the handle/backrest is raised to its full height, the user can pivot the side sections out (like opening window shutters), to form an even wider barrier/shield, pursuant to an embodiment herein. An alternative embodiment of the backrest includes sliding, instead of pivoting, the side sections out.

According to a further definition of the disclosure provided herein is a transportable assembly that can be quickly transformed from a compact, collapsed, transportable mode into an expanded, adjustable toilet seat assembly mode. When collapsed in the transportable mode, the assembly can be approximately twelve inches wide, eight inches long, and four inches high. When expanded, it can be used over generally all varieties of toilets in such a way that it creates a barrier or space between the seating surface of the assembly and for example, the underlying hardware toilet. For example, the expanded frame rectangle can have a length of twenty-four inches (or between eight and twenty-four inches) and a width of twenty-six inches (or between ten and twenty-six inches). And the expanded legs can have lengths of twenty-two inches (or between eight and twenty-two inches).

Alternatively, it can be used in such a way that the longitudinal support bars, for example, rest upon the seat of the underlying hardware toilet. Another alternative is for it to provide a toilet-like seating surface when no actual toilet is available (such as for use while camping, or with a "hole in the floor" type of toilet). A further alternative is to provide a collection bag hanging from the frame and whose open top is aligned with the toilet seat opening in the seat to receive waste. The bag can be removable for replacement and disposal.

According to a yet further definition of the disclosure provided herein is a transportable assembly that can be converted between a compact transportable mode to a custom-sized expanded position via the below-discussed steps, and a method of converting a toilet seating assembly between a compact transportable mode and an expanded deployed mode. According to one embodiment of the steps, a user first pivots each leg from a "flush with the frame" position, to a "perpendicular to the frame" position, allowing each to lock/snap into place. The user can then pivot the handle/backrest so it is perpendicular to the frame. The user can then expand the backmost lateral support bar to the desired width across the back of the toilet (behind the bowl, just in front of where the tank would be in a residential toilet). The user can next deploy the two rear legs to a desired height (via a combination of the spring-loaded release of the inner sections and the pressure latch on the outer section) such that the frame is at the desired height (e.g., just higher than the hardware toilet seat). Next, the user can expand the longitudinal support bars down the length of the toilet, positioning them so that they extend just over the two "sides" of the toilet seat, for example. The user can then expand the front lateral support to the desired width (e.g., just wider than the toilet bowl), and deploy the front two legs in a similar fashion.

The user can now pull the handle/backrest upward, expanding its telescoping supports and thereby expanding the accordion-style barrier/shield. Once expanded to its full height, the user can then pivot the two side sections of the barrier/shield outward, forming the full width. (Alternatively, the user can slide the side sections out to a greater or full width of the shield.) The user can now unfold the seat, first unfolding the stacked panels across the width of the frame, and then unfolding them down the length of the frame so that they rest on top of the longitudinal supports. Any additional length of the fold-out surface can extend over the front lateral support. (Alternatively, the panels can be unfolded down the length and then across the width.) (Other orders of the steps of the conversion process as would be apparent to those skilled in the art are within the present disclosure.)

According to a still further definition of the disclosure provided herein is a collapsible seating assembly for toilet use including a bi-directionally expandable support frame, a carrying handle, a collapsible backrest/shield, height-adjustable legs, and a collapsible seating surface, which makes available an underlying toilet bowl or the like. All components can be collapsible and expandable such that the seating assembly can be easily converted between a compact transportable (or storage) mode and a deployed expanded mode.

The assembly can be generally flat and compact when in the transportable mode, and can be generally chair-like when in the expanded mode. An alternative embodiment omits the opening in the seating surface whereby a regular chair with no toilet-related functions is created. A further alternative embodiment omits the opening in the seating surface, and varies in the measurements of the components such that the features may be utilized to form any number of collapsible furniture structures, such as benches or tables.

According to a still further definition of the disclosure provided herein is a collapsible and expandable toilet seat assembly that includes: a frame and leg assembly including first and second rods parallel to one another, third and fourth rods parallel to one another and perpendicular to the first and second rods, a telescoping first leg pivotally attached to one end of the first rod, a telescoping second leg pivotally attached to an opposite end of the first rod, a telescoping third leg pivotally attached to one end of the second rod, and a telescoping fourth leg pivotally attached to an opposite end of the second rod. First ends of the third and fourth rods are slidably connected to the first rod and second ends of the third and fourth rods are slidably connected to the second rod. And thereby the third and fourth rods are repositionable along the first and second rods between transport and operative positions. The first, second, third and fourth legs are pivotable between transport modes generally in a plane of the first and second rods and operative modes generally perpendicular to the plane. The first, second, third and fourth rods are telescopable between compact transport lengths and operative extended lengths. The assembly can further include a toilet seat construction configurable between an expanded mode to form a seat surface that has a central toilet seat opening and a collapsed mode. With the legs perpendicular to the plane, the first, second, third and fourth rods being at desired operative lengths, and the third and fourth rods being in operative positions, the first, second, third and fourth rods form a support surface/structure for a seat surface.

According to a still further definition of the disclosure provided herein is a collapsible and expandable toilet seat assembly that includes: a frame convertible between collapsed and expanded modes; legs configurable between collapsed and expanded modes; a toilet seat construction (or seating surface assembly) configurable between an expanded mode to form a seat surface that has a central toilet seat opening and a collapsed mode; the toilet seat construction when in the expanded mode being adapted to be operatively supported on the expanded frame with the expanded legs connected thereto and depending down therefrom; and a handle pivotally attached to a rear of the frame and pivotal between a toilet-seat-assembly carrying position lying generally in a plane of the frame and a user back support position disposed generally perpendicular to and extending up from the frame.

1. Disclosed herein is a collapsible seating assembly for toilet use that comprises: a bi-directionally expandable support frame; a carrying handle; a collapsible backrest/shield; height-adjustable legs; a collapsible seating surface; the assembly and all its components are convertible between a compact transportable mode to a deployed expanded mode; the transportable mode includes all telescoping and expandable components in their fully compact and retracted positions such that the assembly is generally flat and compact; and the expanded mode includes the components expanded and deployed to create a level and sturdy, independently structurally supportive (self-supporting) toilet seating surface.

2. Also disclosed herein is an assembly of paragraph 1 above wherein the carrying handle is pivotally attached to the support frame and is parallel with the support frame when in the transportable mode.

3. Also disclosed herein is an assembly of paragraph 1 wherein the carrying handle is pivotally attached to the support frame and is perpendicular to the frame when in the expanded mode.

4. Also disclosed herein is an assembly of paragraph 1 wherein the legs are pivotally attached to the support frame, and are fully retracted and parallel with the support frame and positioned either at the side of or flush beneath the frame when in the transportable mode.

5. Also disclosed herein is an assembly of paragraph 1 wherein the legs are pivotally attached to the support frame, and are perpendicular to the frame and expanded to desired lengths and lockable when in the expanded mode.

6. Also disclosed herein is an assembly of paragraph 1 wherein the legs are attached to the corners of the frame by a hinge, each with its rotation positioned directionally to allow that leg to be rotated parallel with a support of the frame when in the transportable mode.

7. Also disclosed herein is an assembly of paragraph 1 wherein the legs are attached to the frame by a hinge that can be "snapped" or locked into place (and similarly released), both in a "parallel to frame" transportable mode position and in a "perpendicular to frame" expanded mode position, via a spring-loaded pin-and-hole type of fixture or similar means.

8. Also disclosed herein is an assembly of paragraph 1 wherein the legs comprise consecutively smaller telescoping sections.

9. Also disclosed herein is an assembly of paragraph 8 wherein the inner sections of the telescoping leg are deployable to a locked position and retractable by a spring-loaded trigger accessible at the top of the second largest (first inner) section.

10. Also disclosed herein is an assembly of paragraph 9 wherein the spring-loaded trigger is a self-defense or weapon baton-type of spring-loaded trigger.

11. Also disclosed herein is an assembly of paragraph 1 wherein the inner sections of the legs when either deployed or retracted can be lowered from the outer section and locked to a desired height via a pressure latch that grips the largest, outermost section to the second largest, first inner section.

12. Also disclosed herein is an assembly of paragraph 1 wherein the legs have weighted caps that include a small tab, which is perpendicular to the leg and can be leveraged to assist in lifting a leg back to its retracted position.

13. Also disclosed herein is an assembly of paragraph 1 wherein the expandable frame comprises two independently-expandable lateral supports that in the expanded mode of the assembly, expand across the width of the toilet, and two longitudinally-expandable supports that in the expanded mode of the assembly expand down the length of the toilet.

14. Also disclosed herein is an assembly of paragraph 1 wherein the longitudinal supports of the frame are attached to the lateral supports of the frame via loop-like fixtures at both ends of each longitudinal support such that the lateral supports can move through these loops while being expanded, thereby allowing the lateral supports to be expanded independently of one another and thereby set to different widths/lengths.

15. Also disclosed herein is an assembly of paragraph 1 wherein the carrying handle is attached to two small telescopically-expandable components that are pivotally attached to the backmost lateral support of the frame.

16. Also disclosed herein is an assembly of paragraph 1 wherein when the components are retracted, the handle is generally flush with the frame, as in the transportable mode, and when the components are expanded, the handle sits several inches above the frame thereby forming a backrest-type structure, as when in the expanded mode.

17. Also disclosed herein is an assembly of paragraph 1 wherein an expandable surface is attached at its bottom to a point near the frame such that when the carrying handle is raised and the telescoping components are expanded to transform to its backrest-type form, the surface attached between is also expanded forming an additional barrier/shield between the user and any apparatus positioned behind the toilet bowl, and the carrying handle is attached to the top of the expandable surface.

18. Also disclosed herein is an assembly of paragraph 17 wherein the expandable surface includes an accordion-like plastic or rubber structure or a roll-up structure.

19. Also disclosed herein is an assembly of paragraph 17 wherein the apparatus is a toilet tank or a commercial flush.

20. Also disclosed herein is an assembly of paragraph 1 wherein the expandable seating surface when in the transportable mode is at maximum half the width of the seating surface when deployed in the expanded mode.

21. Also disclosed herein is an assembly of paragraph 1 wherein the shape of the expandable seating surface, when in the expanded mode, forms a large opening positionable over a toilet bowl.

22. Also disclosed herein is an assembly of paragraph 1 wherein the expandable seating surface, when in the expanded mode, is positioned such that each side of the surface runs parallel with each side of the toilet seat of the hardware toilet beneath.

23. Also disclosed herein is an assembly of paragraph 1 wherein the length of the expandable seating surface exceeds the set length of the longitudinal supports such that additional surface extends beyond the foremost lateral support and hangs over in front of the assembly to form a barrier/shield between the user and underlying hardware toilet.

24. Also disclosed herein is an assembly of paragraph 1 wherein the sides of the expandable seating surface and a seated user are structurally supported by assembly frame and legs, requiring no contact between the assembly and any hardware toilet beneath.

25. Also disclosed herein is an assembly of paragraph 1 wherein a seated user, the expandable seating surface, and the longitudinal supports rest upon and leverage the underlying toilet for structural support.

26. Also disclosed herein is an assembly of paragraph 1 wherein the expandable seating surface is attached to the frame by hook-like fixtures which allow the seating surface, when the assembly is in both the transportable mode and in the expanded mode, to rest upon the frame while also sliding across the frame supports in order to adjust its position.

27. Also disclosed herein is an assembly of paragraph 1 wherein the expandable or telescoping components are generally cylindrical, rectangular or ovular in shape.

28. Also disclosed herein is an assembly of paragraph 1 wherein the assembly has dimensions of approximately twelve inches wide, eight inches long, and four inches high when in the transportable mode.

Further objects and advantages of the present disclosure will become apparent from a consideration of the drawings and ensuing description.

DETAILED DESCRIPTION

Figure 1:
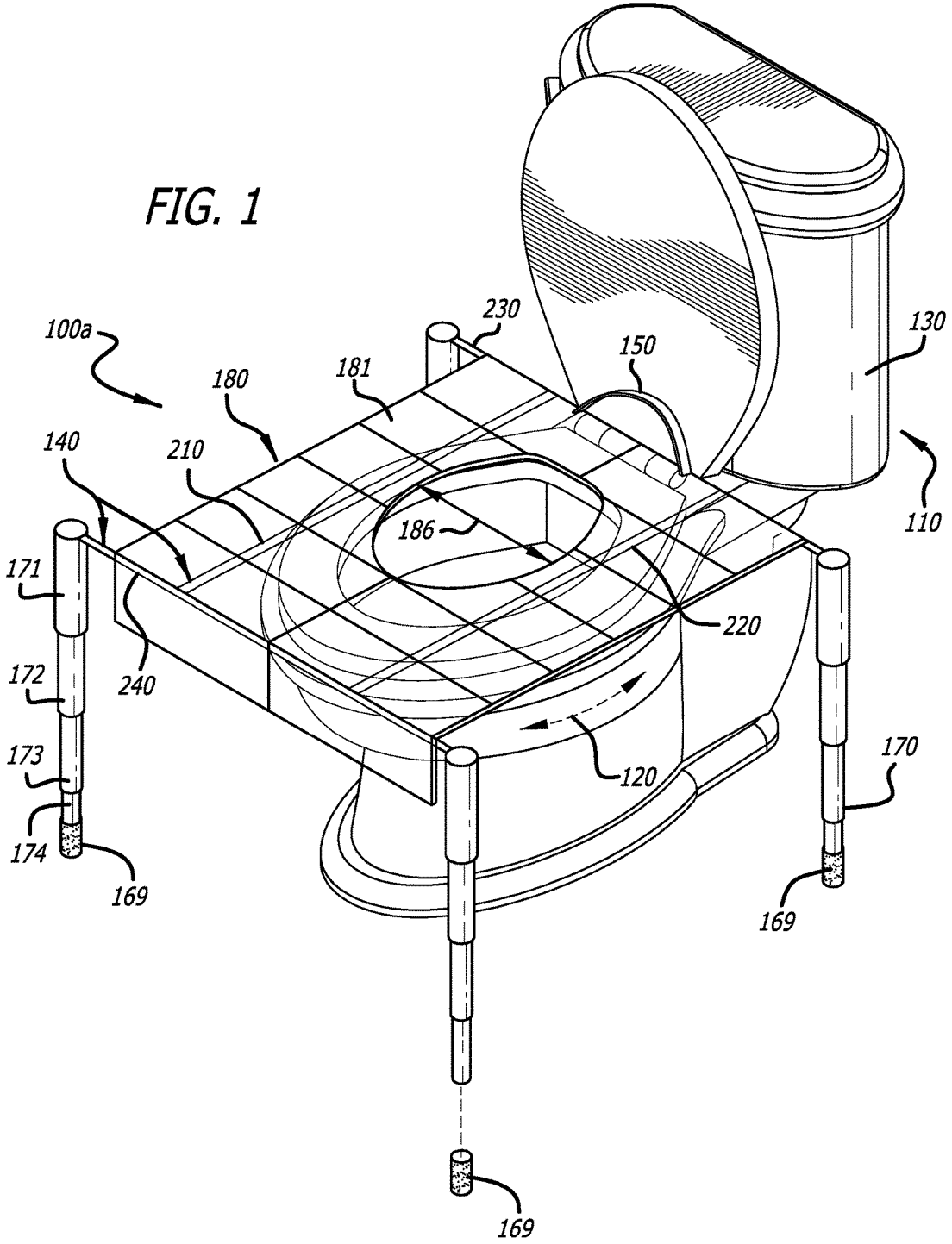
FIG. 1 is a front perspective view of an assembly of the present disclosure in position over a toilet and in an expanded operable mode.
Figure 2:
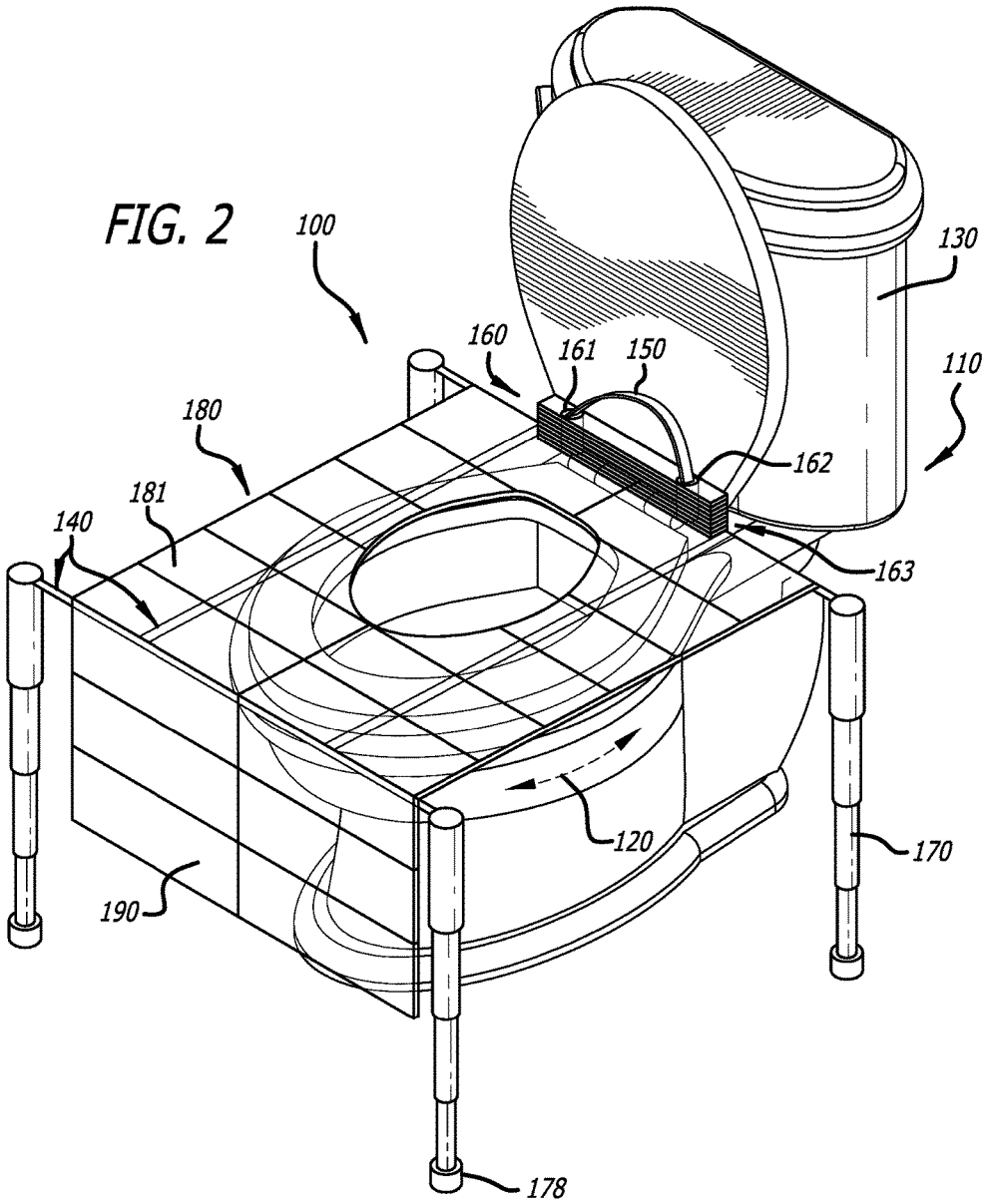
FIG. 2 is a front perspective view of another assembly of the present disclosure including an accordion backrest/shield (illustrated in its compact position) attached to the carrying handle that in turn is attached to the backmost lateral support of the frame by two telescoping fixtures, weighted caps at the foot of each support leg, and an additional length of the paneled seating surface extending over the frame's forwardmost lateral support to form an additional shield between the user and the underlying hardware toilet.

A collapsible seating assembly of the present disclosure is illustrated generally at 100 in FIG. 2, partially deployed and shown in position over a toilet as depicted generally at 110 and including a bowl 120 and a tank 130. The collapsible seating assembly 100 is illustrated in a deployed expanded mode in FIG. 6, and an alternative assembly embodiment 100*a* is illustrated in FIG. 1.

The collapsible seating assembly 100 can include a bi-directionally expandable support frame 140, a carrying handle 150, a collapsible backrest/shield 160, height adjustable legs 170, and a collapsible/foldable seating surface assembly 180.

The telescoping components (such as the longitudinal frame supports, the lateral frame supports, the handle/backrest attachments and the support legs) can be made of a sturdy lightweight metal such as aluminum, or of durable plastic such as PVC. The telescoping components may be cylindrical, ovular or generally flat in shape.

Figure 4:
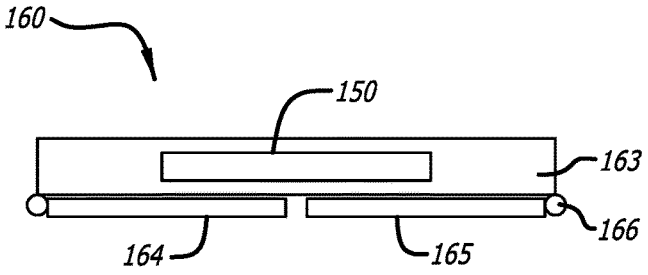
FIG. 4 is a top view of the backrest/handle as shown in FIG. 3, with the side portions of the backrest barrier/shield pivotally attached to the center section and not expanded.
Figure 5:
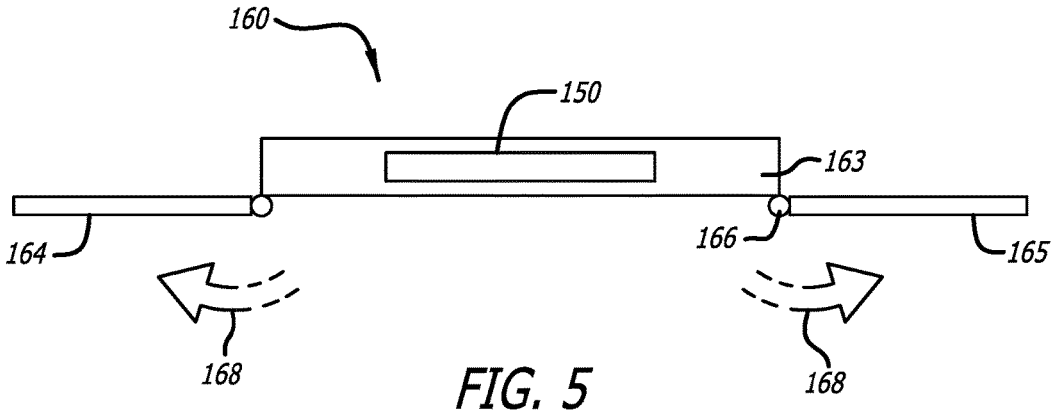
FIG. 5 is a top perspective view of FIG. 4 showing the side portions of the backrest barrier/shield having been rotated outward to their expanded position, creating the full width of the backrest barrier/shield.

The support frame illustrated generally at 140 in FIG. 2, for example, includes two longitudinal frame supports (or rods) 210, 220 that can expand telescopically down the length of the toilet (that is, directionally (longitudinally and in a horizontal plane) (arrow 234 in FIG. 4) from the toilet tank 130 to the front 125 of the toilet bowl 120), and two lateral frame supports (or rods) 230, 240 that can expand telescopically across the width of the toilet (that is, (horizontally) from one side 126 of the toilet bowl to the other side 127, and out beyond both sides). (See arrows 242 in FIG. 13.) These telescoping components can be held in their retracted/compact or deployed/expanded positions via friction, or for example by pins or a locking spring mechanism. They can be expanded or collapsed by a user pulling or pressing the component in the desired direction.

Figure 29:
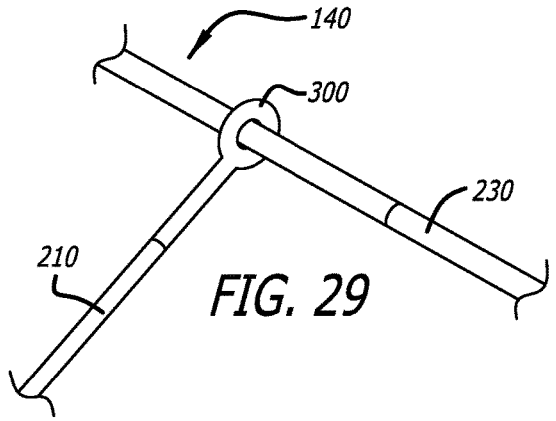
FIG. 29 is an enlarged perspective view showing the loop-like fixture (e.g., eyelet) of a longitudinal support of the frame of the assembly as it is attached to a lateral support of the frame. When the lateral supports are expanded, they move through these loops. As such, the longitudinal supports can "slide" across the lateral supports, advantageously allowing the two lateral supports to be expanded independently of one another and thereby set to different widths per, for example, the underlying toilet's requirements.

On both ends of each longitudinal frame support 210, 220 are loop-like fixtures or eyelets 300 (as shown, for example, in FIGS. 29 and 31), which are attached to a lateral frame support so that when the lateral supports 230 and 240 are expanded they move through these loops. As such, the longitudinal supports 210, 220 can "slide" across the lateral supports 230, 240, allowing the two lateral supports to be expanded independently of one another and thereby set to different widths per the underlying toilet's requirements or user's needs. (An alternative embodiment can instead have the eyelets on the ends of the lateral frame supports.)

Figure 3:
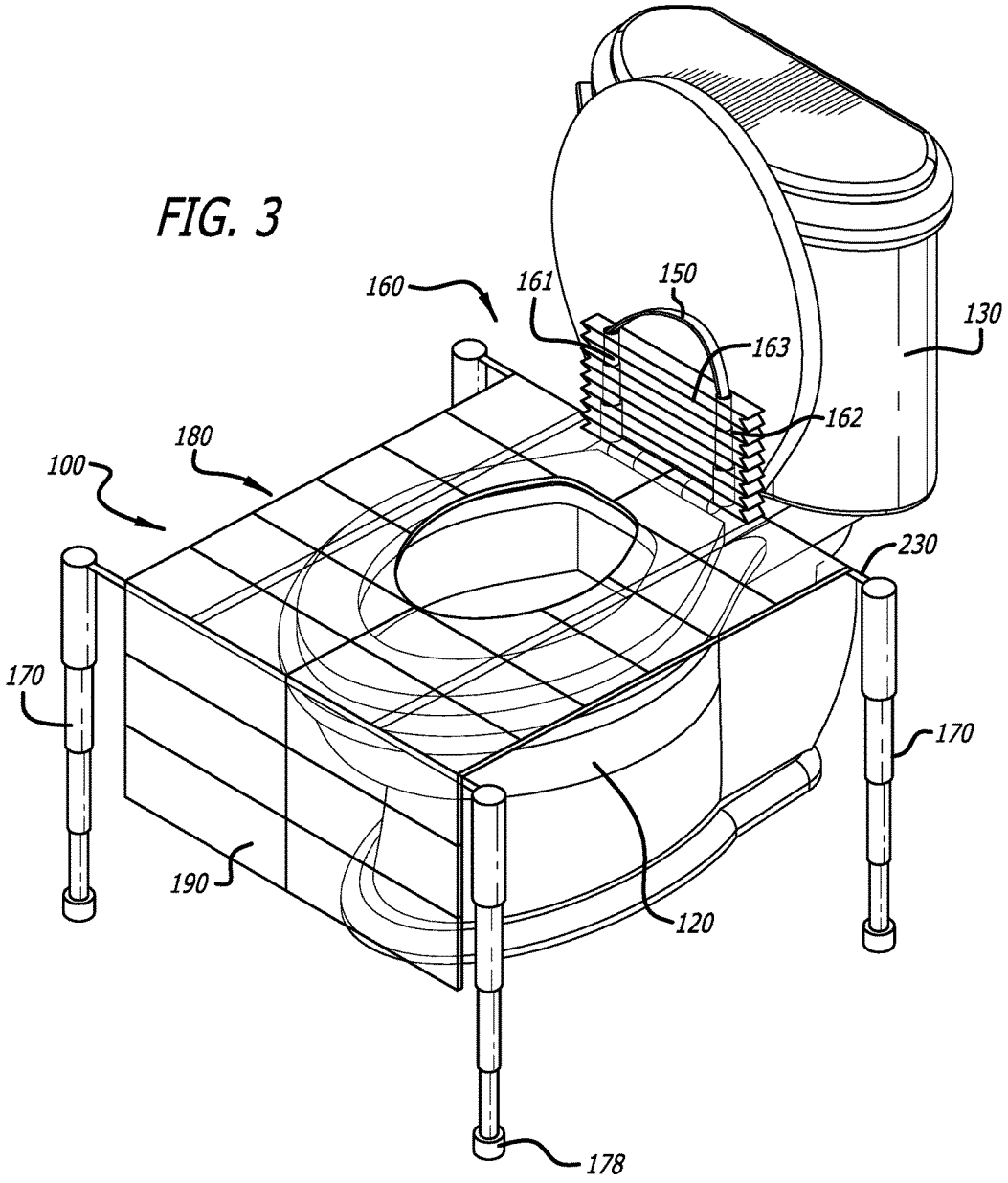
FIG. 3 is a front perspective view of the assembly of FIG. 2 showing the backrest/handle having been raised, thereby expanding the telescoping fixtures and the accordion backrest shield attached thereto.
Figure 19:
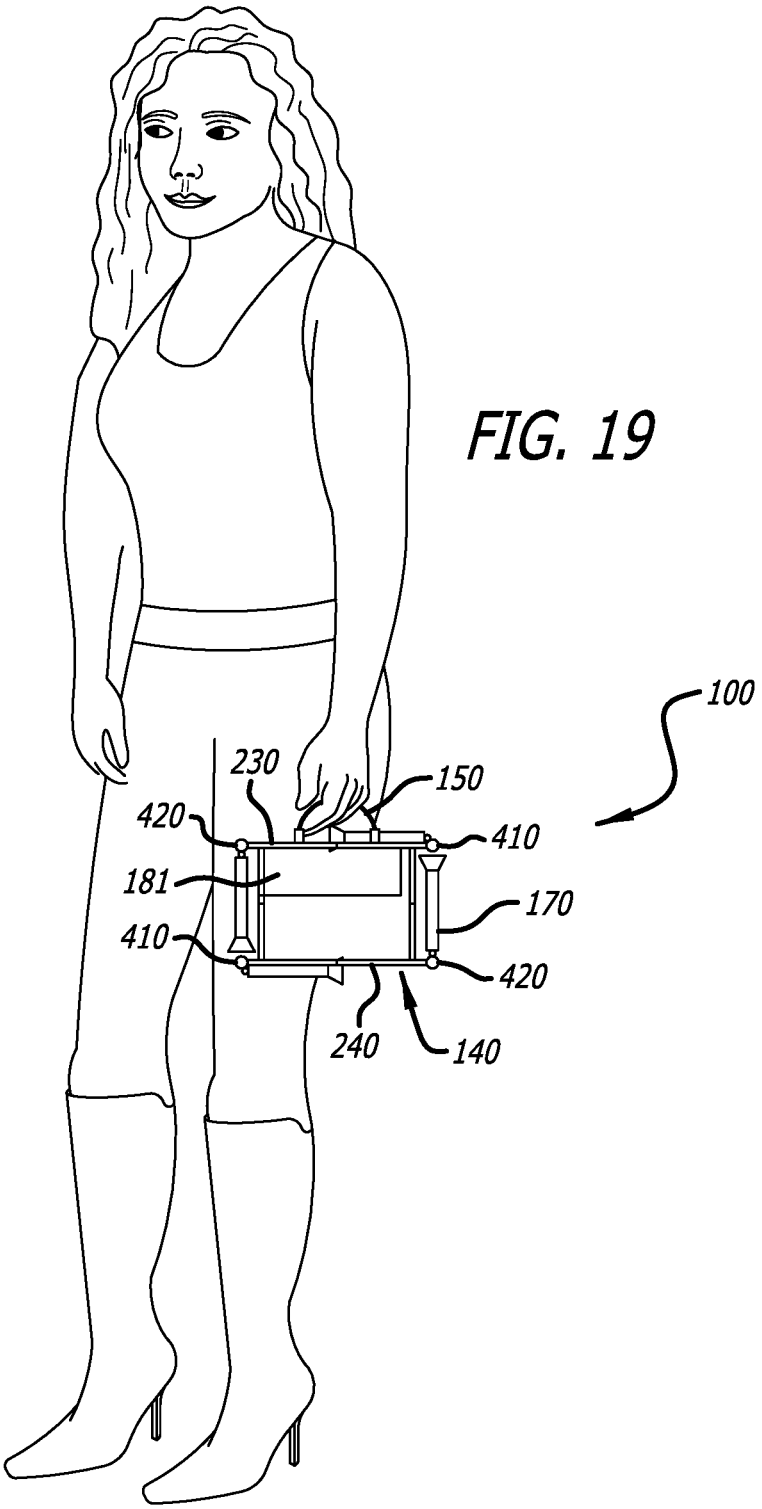
FIG. 19 is a perspective view of an assembly of the present disclosure in its compact transportable mode and being carried by a user. Here, all telescoping components are fully retracted/collapsed. The carrying handle, which is pivotally attached to the frame, is rotated so as to be in a plane parallel with the frame. The telescoping legs, attached to the frame by hinge-like fixtures, are rotated so as to be parallel or flush with the frame. The panels of the fold-out seating surface are fully folded with both sides stacked on top of one another, and held to the frame such as via hook-like fixtures (as shown in FIGS. 29 and 30).

The collapsible seating assembly 100 can include a carrying handle 150 with an expandable barrier/shield component 160 that converts into a backrest-like structure. The combination handle 150 and backrest barrier/shield 160 is attached to the back lateral support 230 by a hinge-like fixture that allows these components to be pivoted to a position either parallel with or perpendicular to the support frame 140. When in a compact transportable mode, the handle 150 can be parallel to the plane of the support frame, as shown in FIG. 19. When the assembly 100 is in a deployed mode, the handle 150 can be pivoted so that it is disposed perpendicular to the support frame, as shown in FIG. 3, for example. The assembly 100 may include the combination of the handle 150 and backrest barrier/shield 160 as shown in FIG. 2, or may be a version as shown by assembly 100*a* in FIG. 1 that includes the handle 150 pivotally attached to the frame at the center of the back lateral support 230 and without the backrest barrier/shield.

As shown in FIG. 3, the backrest barrier/shield 160 can include two telescoping supports (e.g., posts) 161, 162 and an expandable surface 163, which may have an accordion blind-like construction (e.g., honeycomb shades), or alternatively a roll-up construction. The expandable surface 163 may be made of plastic or rubber, such as a sturdy washable material. The expandable surface 163 can be attached at its bottom to a point on or near the back lateral support 230 and at its top to a point at, near or level with the tops of the two telescoping supports 161, 162 of the barrier/shield 160. The carrying handle 150 can be attached to the top of the telescoping supports 161, 162. When the backrest barrier/shield 160 is in its collapsed position (FIG. 2), the top of the expandable surface 163 is in a lower position near the back lateral support 230. To deploy, a user pulls the handle 150 upward, thereby expanding the surface 163 as the telescoping supports 161, 162 are expanded.

Figure 7:
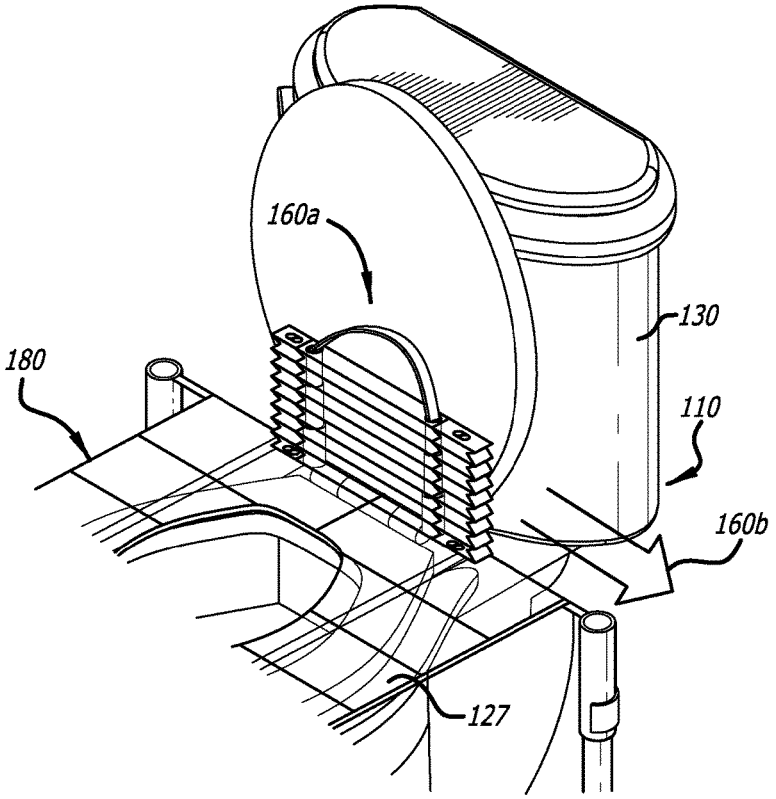
FIG. 7 is a view similar to FIG. 3 but illustrating an alternative backrest construction of the present disclosure having outwardly slidable, instead of outwardly pivotable, side panels with the arrow showing the right panel being slid out.
Figure 8:
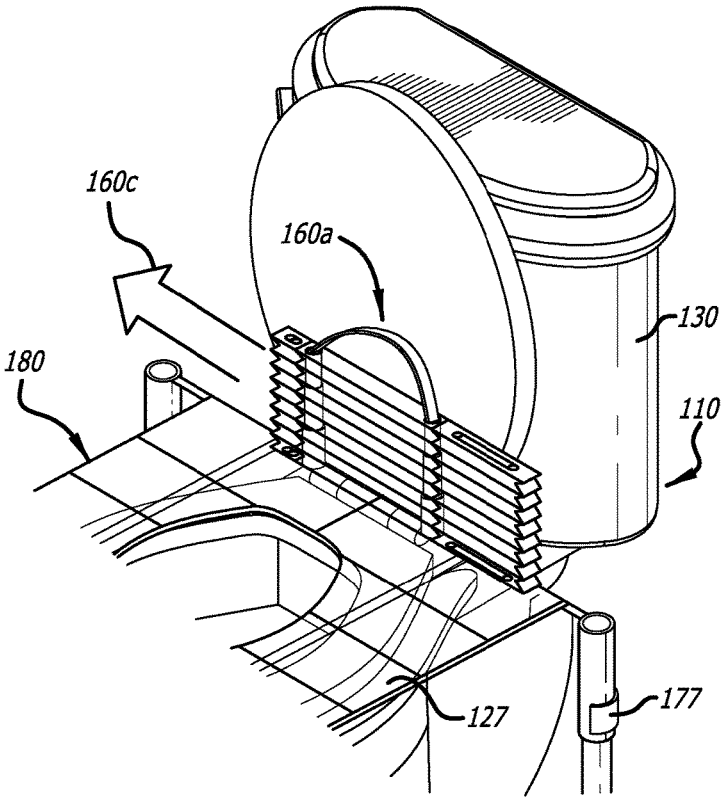
FIG. 8 is a view of the assembly of FIG. 7 in position over a toilet and with the arrow showing the left panel of the alternative backrest construction being slid out.
Figure 9:
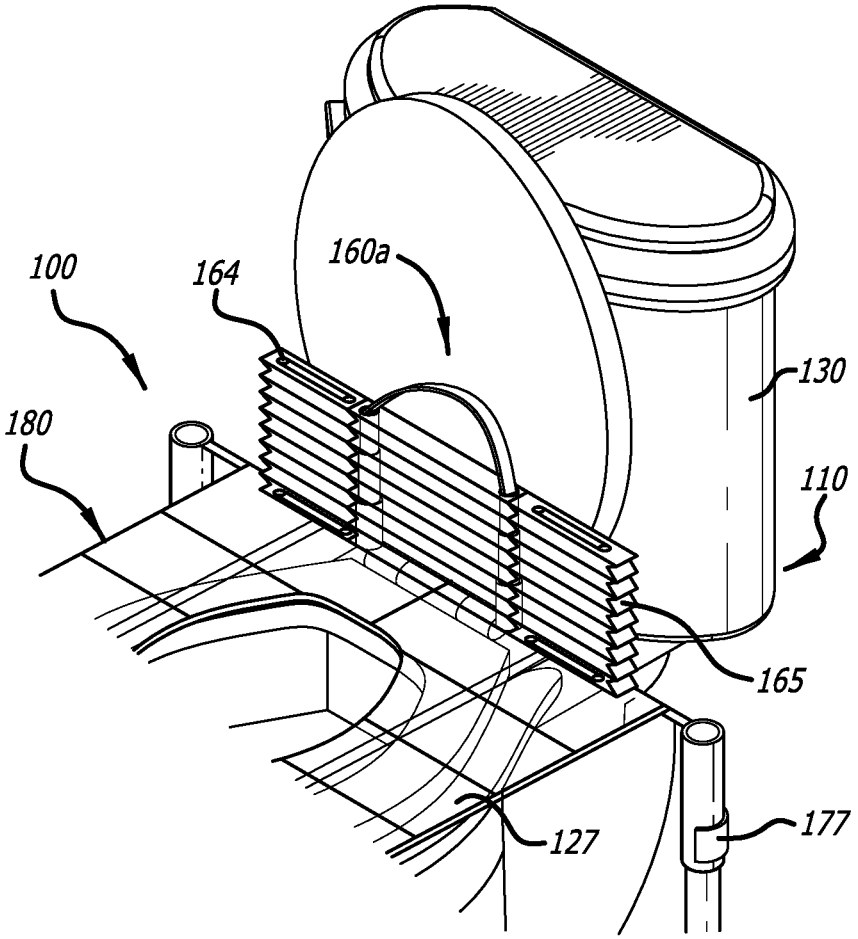
FIG. 9 is a view similar to FIG. 8 but with both side panels in slid-out expanded positions.
Figure 14:
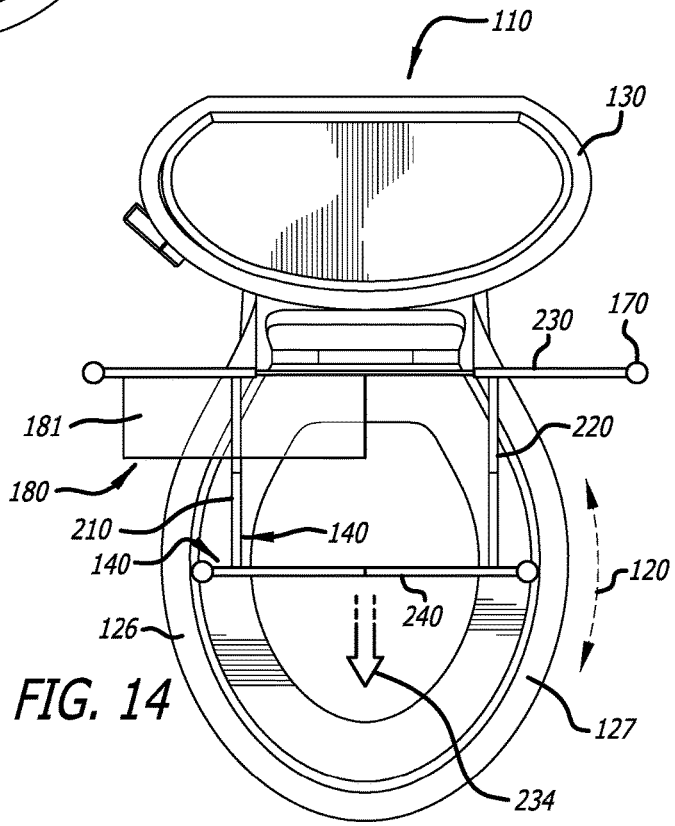
FIG. 14 is a top perspective view of the assembly of FIG. 13 shown being converted from a compact transportable mode to a deployed expanded mode, after the step shown in FIG. 13. The longitudinal supports of the frame are shown by the arrow being expanded down the length of the toilet.
Figure 15:
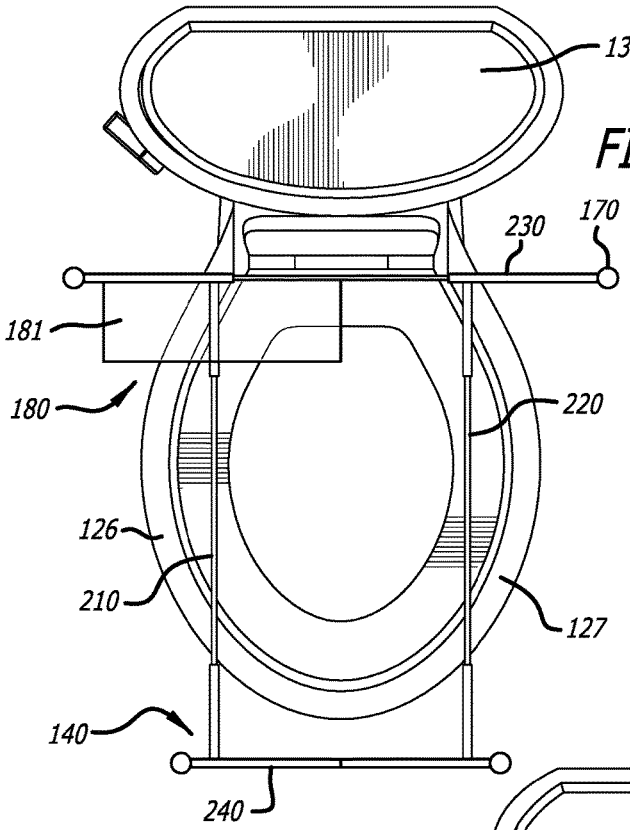
FIG. 15 is a view similar to FIGS. 13 and 14 showing the backmost lateral support and both longitudinal supports having been fully expanded for use with the underlying toilet.

The backrest barrier/shield 160 may also include additional widths or panels 164, 165 (see FIGS. 14, 15 and 16) on both sides that open out, like accordion window blinds or shutters, to either side after the backrest barrier/shield has been vertically expanded (or alternatively before). The additional widths 164, 165 are attached to the outside edges of the expandable surface 163 by a hinge or seam 166 that allows them to rotate outward (arrows 168 in FIG. 15). Alternatively, they can be attached by an overlapping track that allows them to extend by sliding outward as shown in FIGS. 7, 8 and 9 at 160*a*. These widths 164, 165 can, for example, be constructed of similar materials and in a similar style to the center portion of the expandable surface 163. One or both can be slid out (fully or partially) as shown by arrows 160*b*, 160*c*, and they can be snapped in place, if desired.

Figure 21:
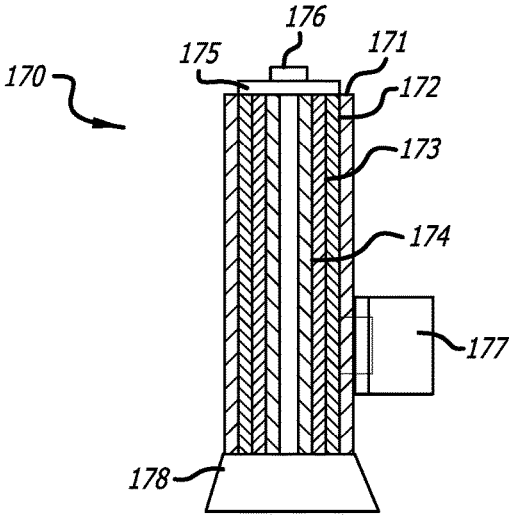
FIG. 21 is a side elevational view of one of the telescoping legs showing a cutaway view into the leg illustrating the relative positions of the sections of the leg and other components. The leg is illustrated in its fully retracted position. The release/retract button, attached to the top of the second outermost section of the leg, protrudes through an opening in the top of the outermost section of the leg and thereby is accessible by a user. The pressure latch attached to the outermost section is in the unlocked position. The end cap, attached to the bottom of the innermost section, is flush with the bottoms of all four sections of the leg.
Figure 22:
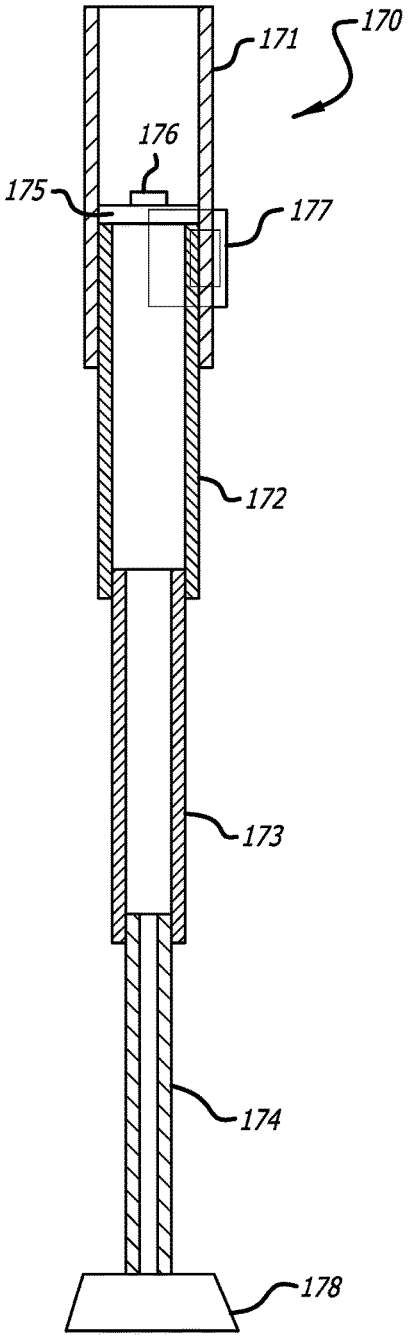
FIG. 22 is a view similar to FIG. 21 but showing the leg deployed to its maximum length in a fully extended position. The pressure latch is in its locked position, securely holding the outermost section and the second outermost section in position. Although the interiors of the three inner sections are depicted as hollow or empty in this view, they can contain the mechanisms (such as the spring loaded or similar to technology of U.S. Pat. No. 6,231,447 (Pelkey) and lockable/releasable mechanism for telescoping units similar to U.S. Pat. No. 2,892,647 (O'Neill)) (entire contents of both of which are hereby incorporated by reference) to quickly and automatically extend and retract the three innermost sections as triggered by the release/retract button at the top of the second outermost section.
Figure 23:
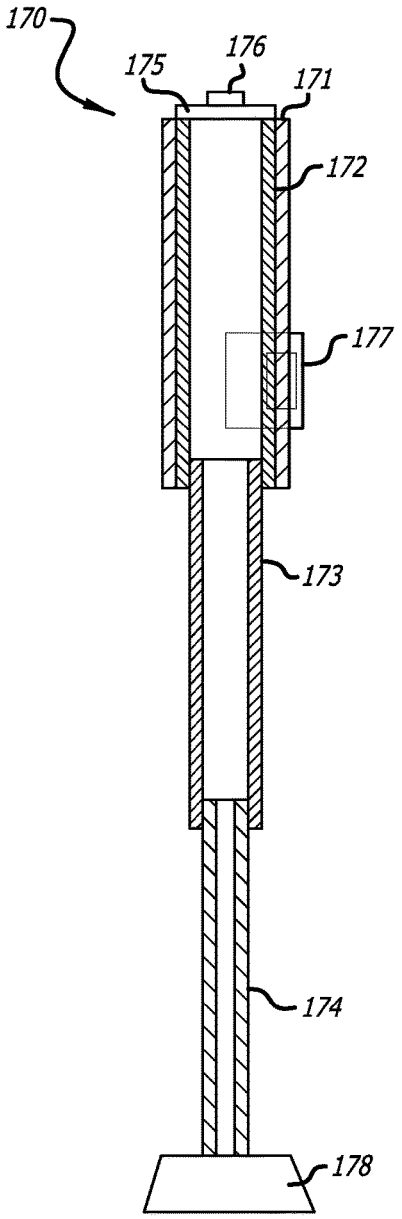
FIG. 23 is a view similar to FIG. 22 but showing the three innermost sections fully deployed, but not extended out from the outermost section. The pressure latch is locked, holding the innermost sections securely in this position. As such, the release/retract button, attached to the top of the second outermost section, extends out from the opening at the top of the outermost section and thereby accessible to the user.
Figure 24:
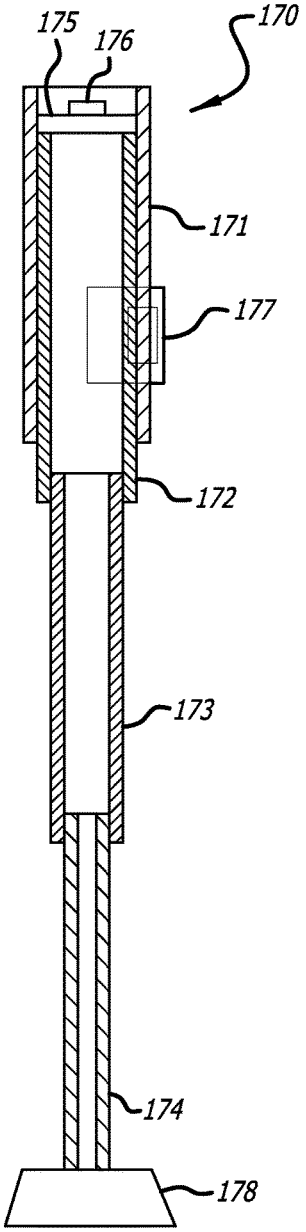
FIG. 24 is a view similar to FIG. 22 but with the innermost sections only partially extended from the outermost section, and secured in place by the locked pressure latch. In this position, the release/retract button is not accessible by the user.
Figure 25:
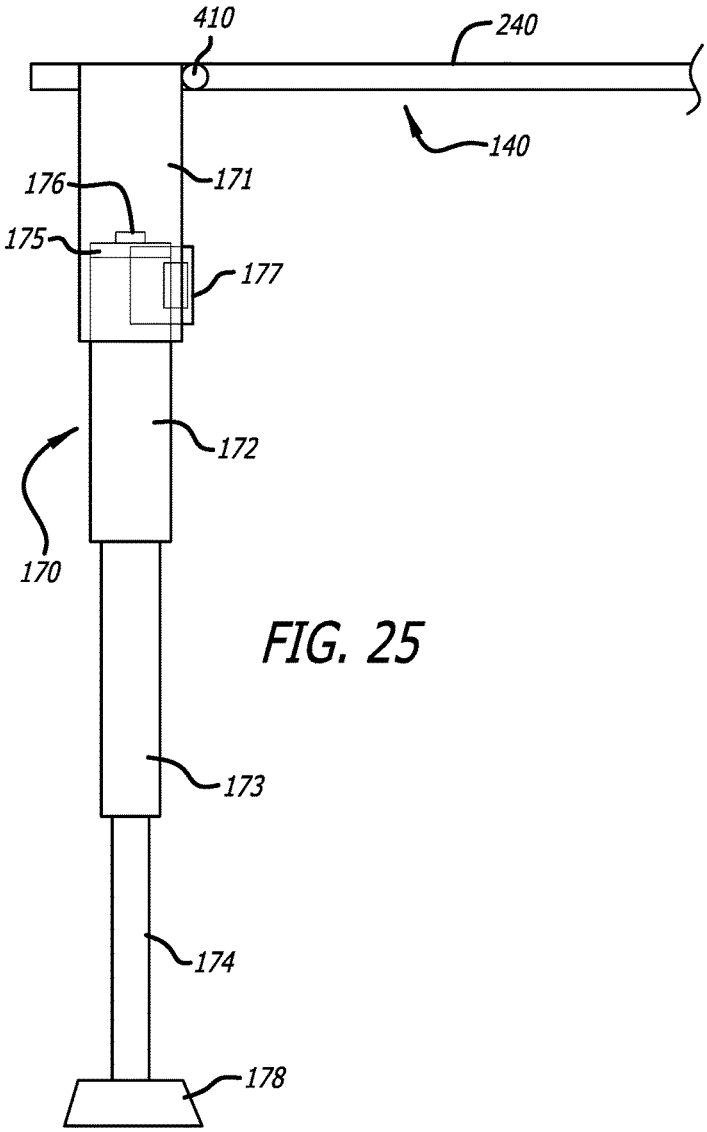
FIG. 25 is a side elevational view showing the telescoping leg expanded to its full height, and rotated on its attachment hinge (and "clicked into place") so as to be perpendicular with the support frame during a deployed expanded mode. The pressure latch is in its locked position, securing the position of the three innermost sections in relation to the outermost section.

The four telescoping legs 170 can have the same construction and an example of one of them is shown in detail in FIGS. 21, 22, 23 and 24. They can include outermost section 171, and two or three consecutively smaller inner sections. The drawing figures show three inner sections, namely, a first innermost section 172, a second innermost section 173, and a third innermost section 174. The innermost sections 172, 173, 174 can contain therein mechanisms (such as spring-loaded, automatically locking, and/or quick releasing) for quick and automatic deploying and retracting to allow these sections to be adjusted between their retracted position (as shown in FIG. 21) and their expanded position (as shown in FIGS. 22, 23 and 24). The deployment and retraction can be triggered by a button, latch or similar device 176 positioned at the top 175 of the first innermost section 172. The amount of extension of the inner sections 172, 173, 174 from the outermost section 171 can be adjusted by a pressure latch 177 located near the bottom edge of the outermost section 171 and which allows the inner sections 172, 173, 174 to be extended from the outermost section 171 to a desired length (such as fully extended as shown in FIG. 22 or partially extended as shown in FIG. 24) and then securely locked in position. Alternatively, the pressure latch 177 can be locked so that the inner sections are not extended from the outermost section 171 (as shown in FIG. 23), either fully retracted (as shown in FIG. 21) or fully deployed (as shown in FIG. 22).

"Pressure latch" can refer to the type of pressure latches often found on camera tripods, for example, or on height-adjustable handlebars found on Bugaboo strollers. They can achieve a pressure holding function, for example by using a lever with a camming device, or a twisting or screw device. The latch can be positioned at the bottom opening of the outermost section of the telescoping unit. When open, no pressure is applied to the next largest section (housed within the outermost section), so it can be extended and easily pushed back into the outermost section. As the latch is closed, it presses against the inner section so that it is not as easily moved. When the latch is fully closed, the pressure can be such that the innermost section cannot be moved and is thereby locked in place. Telescoping legs 170 of the present disclosure can also use pressure latches (e.g., 177) at various joints of the legs to achieve custom lengths.

Another method is to have a plurality of longitudinally aligned holes in at least one of the innermost sections. The adjacent innermost section has one or more holes which the user then aligns with the corresponding holes in the other section and then inserts a locking pin into the aligned holes so that the two sections define a desired length.

Figure 10:
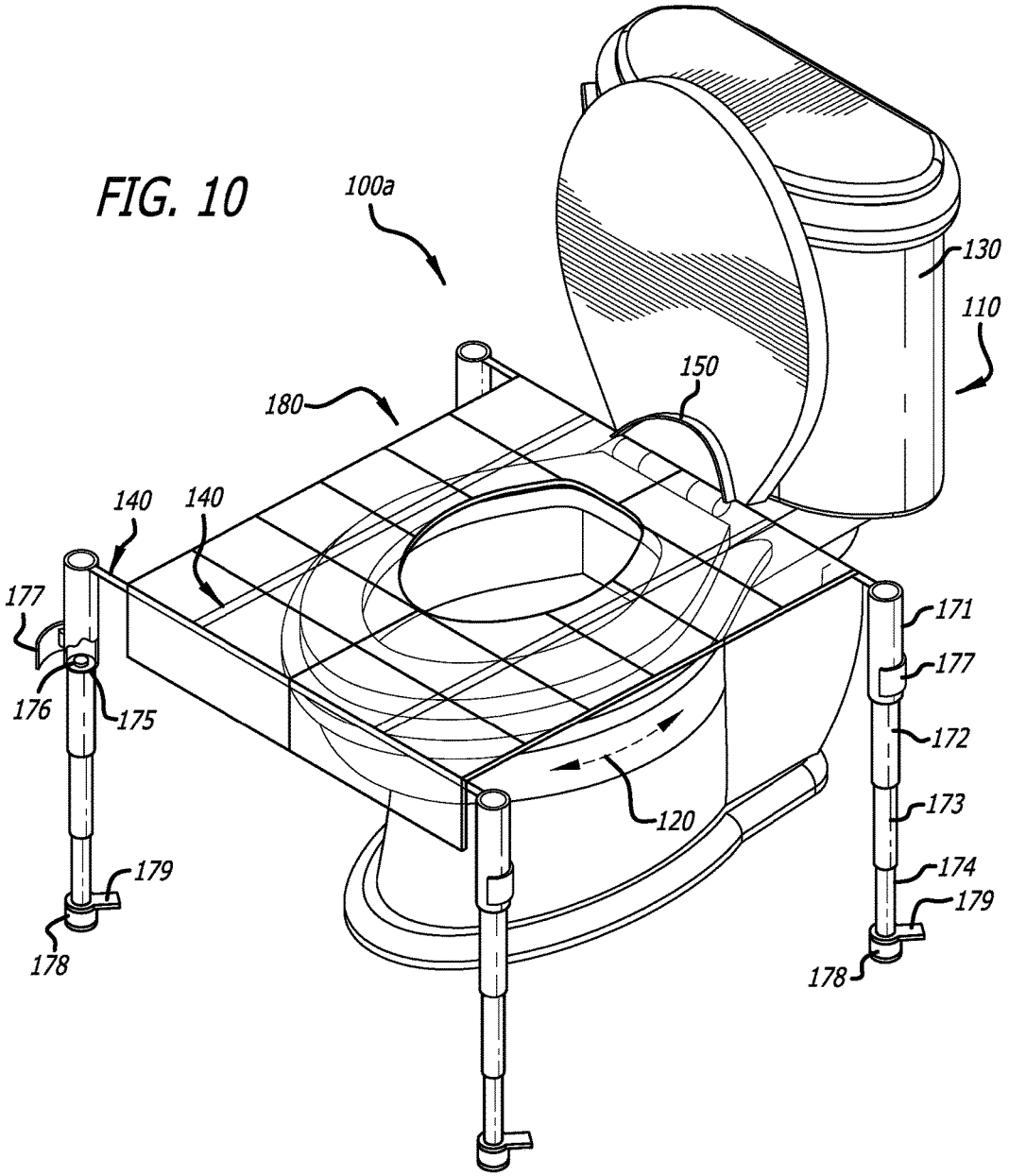
FIG. 10 is a front perspective view of an alternative assembly of the present disclosure, similar to that of FIG. 1 but with a different leg construction.
Figure 11:
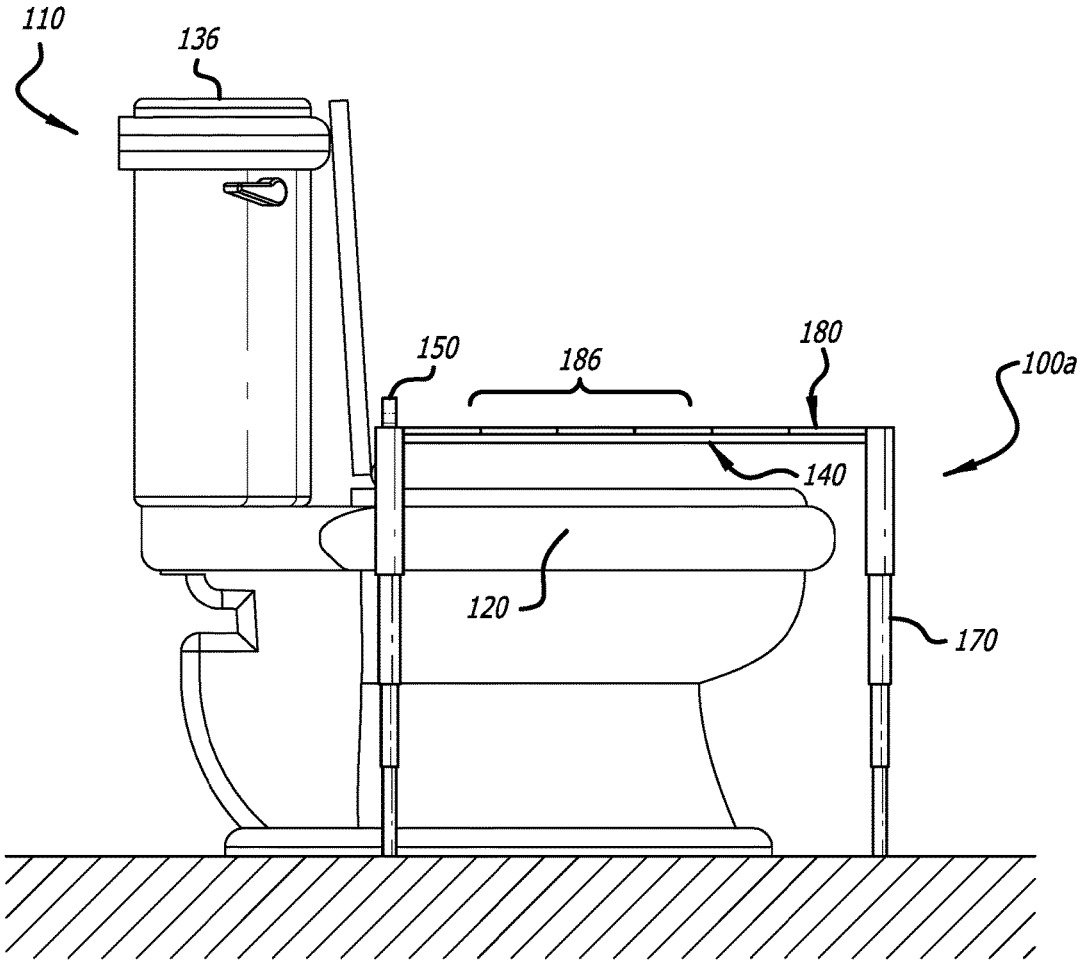
FIG. 11 is a side elevational view of the assembly shown in FIG. 1 illustrated in an expanded mode and in position over a toilet.

Each leg 170 may include an end cap 178 (shown in FIGS. 21 and 6, for example), possibly weighted, and attached to the bottom of the first innermost section 174 of the leg. The end caps 178 provide additional stability for the deployed leg. If weighted, the leg caps 178 can help facilitate dropping the leg 170 toward the ground when it is released for deployment. The leg caps may include a tab 179 (FIGS. 6 and 10), attached to the side near the topmost edge of the cap 178, and extending out perpendicular to the leg 170. These tabs 179 may allow a user to use her foot to help lift the leg 170 back to its collapsed position by pushing the telescoping sections 171, 172, 173, 174 up into each other and thereby in their retracted positions.

Protective caps (or covers) 169 (FIG. 1) can be provided for the lower ends of the legs 170. They can be constructed similar to probe covers for ear thermometers. They are removable when dirty, such as after a use of the assembly in a deployed mode and in a toilet environment. Fresh clean caps 169 can be applied for subsequent uses/deployments of the assemblies 100, 100*a*.

Instead of telescoping arrangements, the legs can be formed with fold-out arrangements, like a folding cane, which also allow them to be easily converted between a long operative condition and a shorter compact transportable/storage condition.

Figure 16:
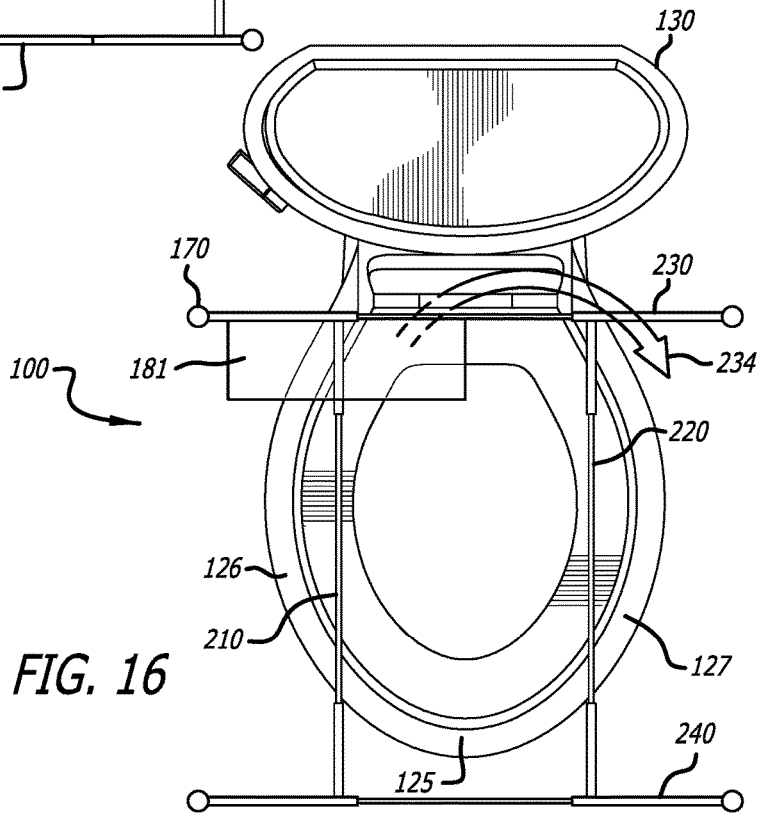
FIG. 16 is a view similar to FIG. 15 showing the forwardmost lateral support of the frame having been expanded across the width of the toilet. The frame is thereby shown in its fully expanded position and the stacked panels of the fold-out seating surface are shown by the arrow being folded out once across the width of the toilet.
Figure 20:
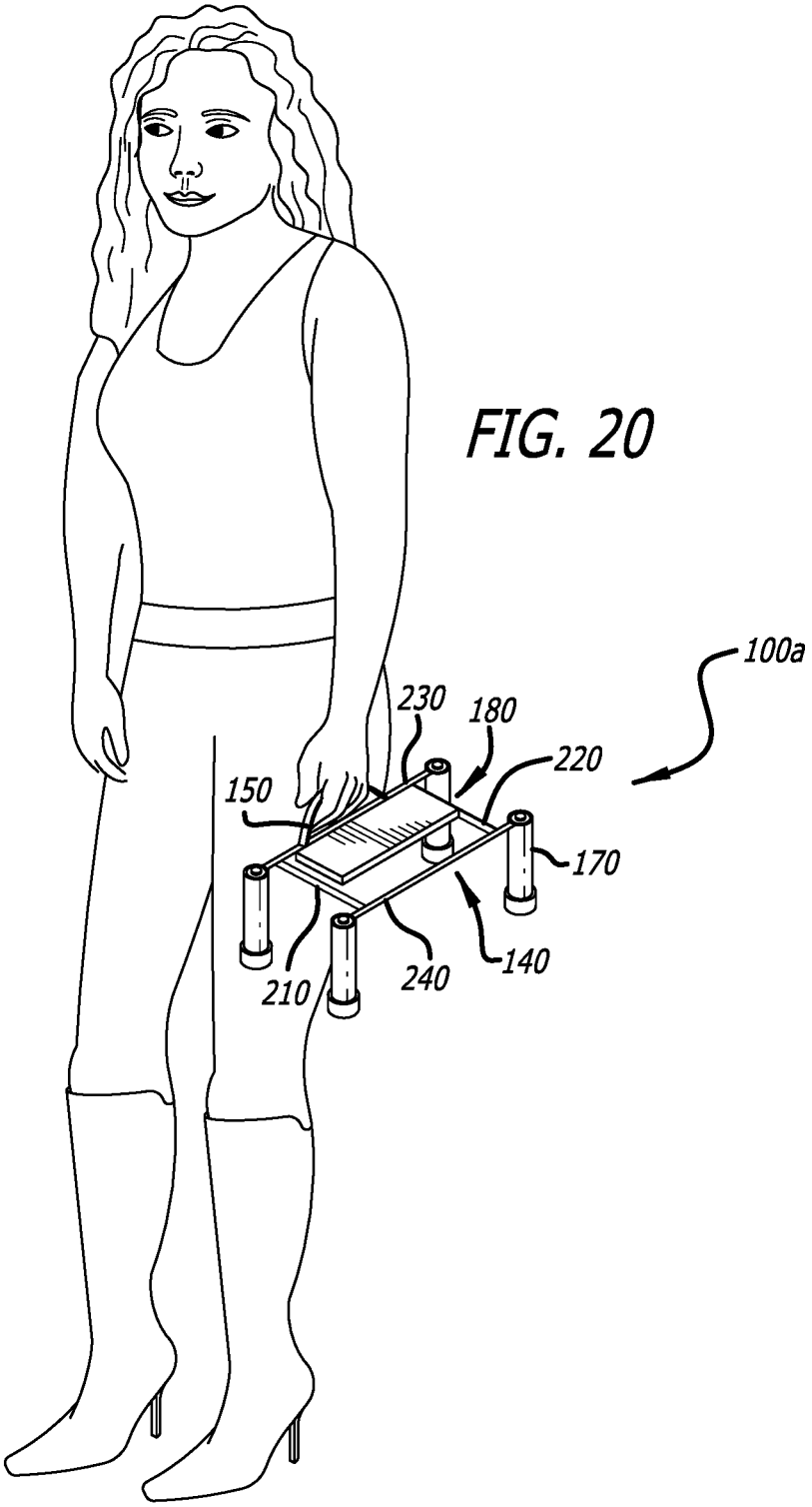
FIG. 20 is a view similar to FIG. 19 showing the assembly having been partially converted from its compact transportable mode to its deployed expanded mode. Here, the carrying handle has been rotated so as to be perpendicular to the seating surface. The telescoping support legs have been rotated and snapped into place so as to be perpendicular to the frame.
Figure 26:
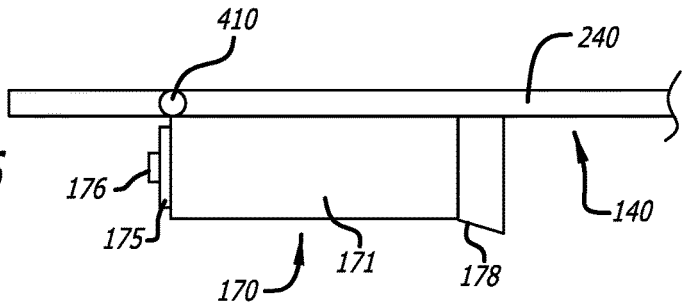
FIG. 26 is a side elevational view showing the telescoping leg fully retracted, and rotated on its attachment hinge so that it is flush with/parallel to the support frame such as when in a compact transportable mode.

The four legs 170 are attached to the expandable frame 140 at both ends of the two lateral supports 230, 240 as shown in FIGS. 16, 19 and 20. Each leg 170 can be attached by a hinge 410 (e.g., FIGS. 25, 26, 27, 28 and 32) directionally positioned such that each leg can be folded up to extend parallel with a respective one of the four frame supports 210, 220, 230, 240. As shown in FIG. 19 and by the arrows 424, 428 in FIG. 15, two of the four above-mentioned hinges 410 allow a leg to be folded parallel to a lateral support 230, 240, and the other two of the four above-mentioned hinges 420 allow a leg to be folded parallel to a longitudinal support 210 and 220. When in a collapsed transportable mode, the legs 170 are pivoted about hinges 410, 420 so the legs are parallel with the frame 140 (and its supports 210, 220, 230, 240) as shown in FIG. 26. When in the deployed expanded mode, the legs have been rotated about hinges 410, 420 so the legs are perpendicular to the frame 140 as shown in FIG. 27.

Figure 17:
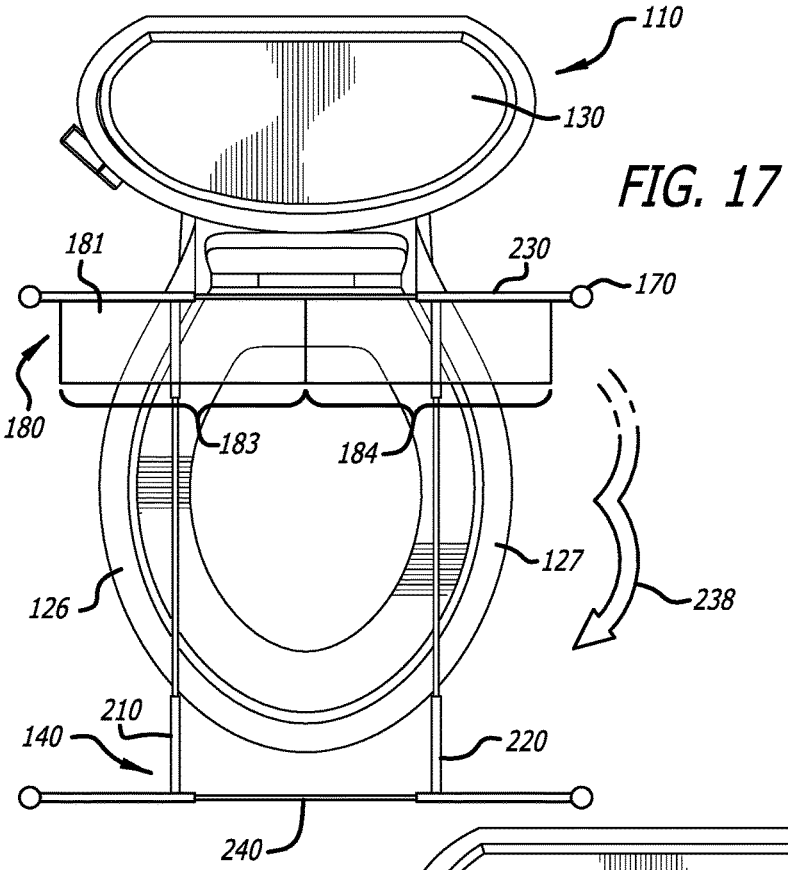
FIG. 17 is a view similar to FIG. 16 showing the stacked panels of the fold-out seating surface having been folded out once across the width of the toilet (so that there are now two stacks of panels), with both sides of the panels shown (by the arrow) being unfolded down the length of the toilet.
Figure 27:
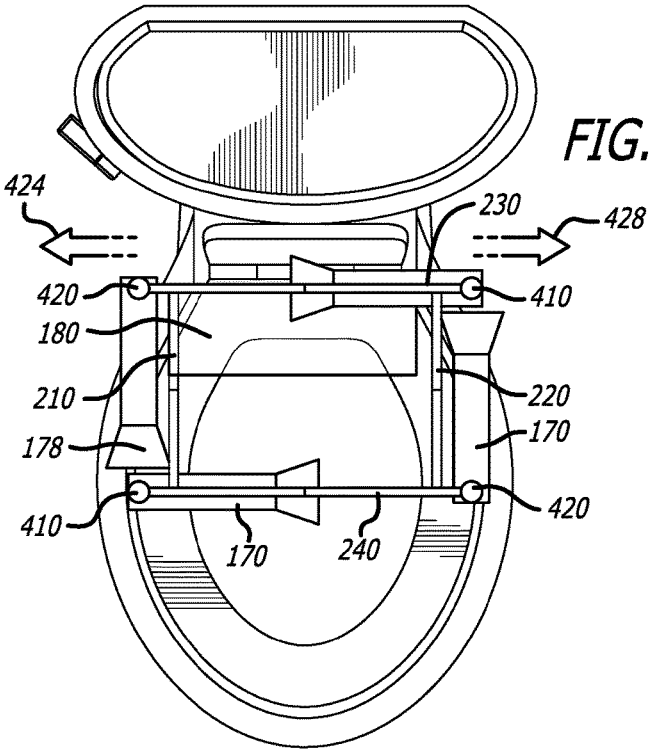
FIG. 27 is a top view of FIG. 26 but showing the entire assembly (instead of just the leg and frame support). Here, all four support legs are fully retracted and rotated up to be parallel with the plane of the frame during the compact transportable mode. The backmost lateral support is being expanded across the width of the toilet, as shown by the arrows.
Figure 28:
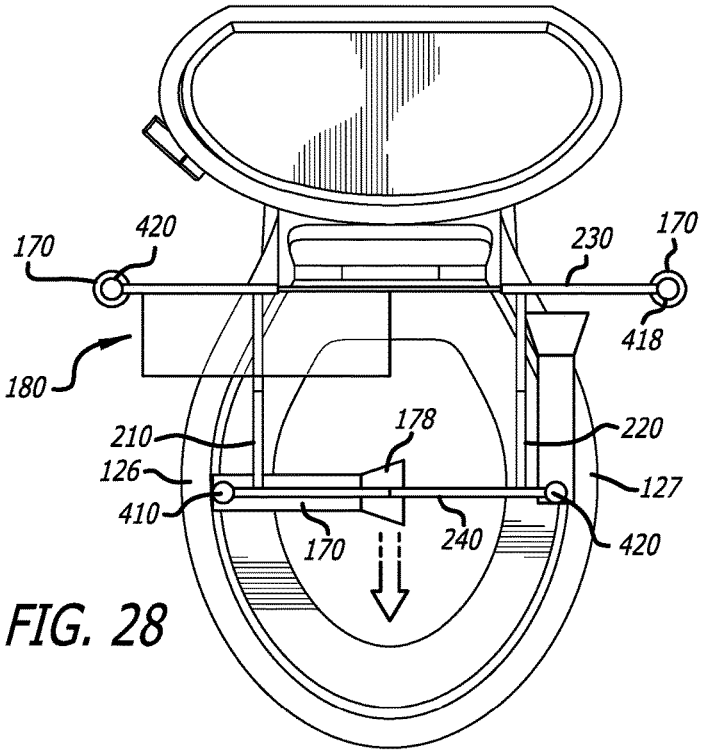
FIG. 28 is a view of the assembly of FIG. 27 but showing the backmost lateral support of the frame expanded across the width of the toilet and the two back support legs having been rotated down so as to be perpendicular to the frame. The two front support legs are still in the position as shown by FIG. 26. The two longitudinal supports of the frame are being expanded down the length of the toilet, as shown by the arrow.

These components, positions and features are also shown in FIGS. 27 and 28 as the legs are being moved from their transportable to expanded position. (Arrows 424 and 428 show the legs being moved in the opposite direction.) FIG. 27 shows all four legs 170 in their transportable position whereas FIG. 28 shows the back two legs having been rotated into their expanded position and the front two legs still in their transportable position. A user may choose to rotate the legs 170 from a transportable position to an expanded position either before the frame 140 has been expanded (as shown in FIG. 20), when the frame 140 is partially expanded (as shown in FIG. 28), or when the frame 140 is fully expanded (as shown in FIG. 17).

Figure 6:
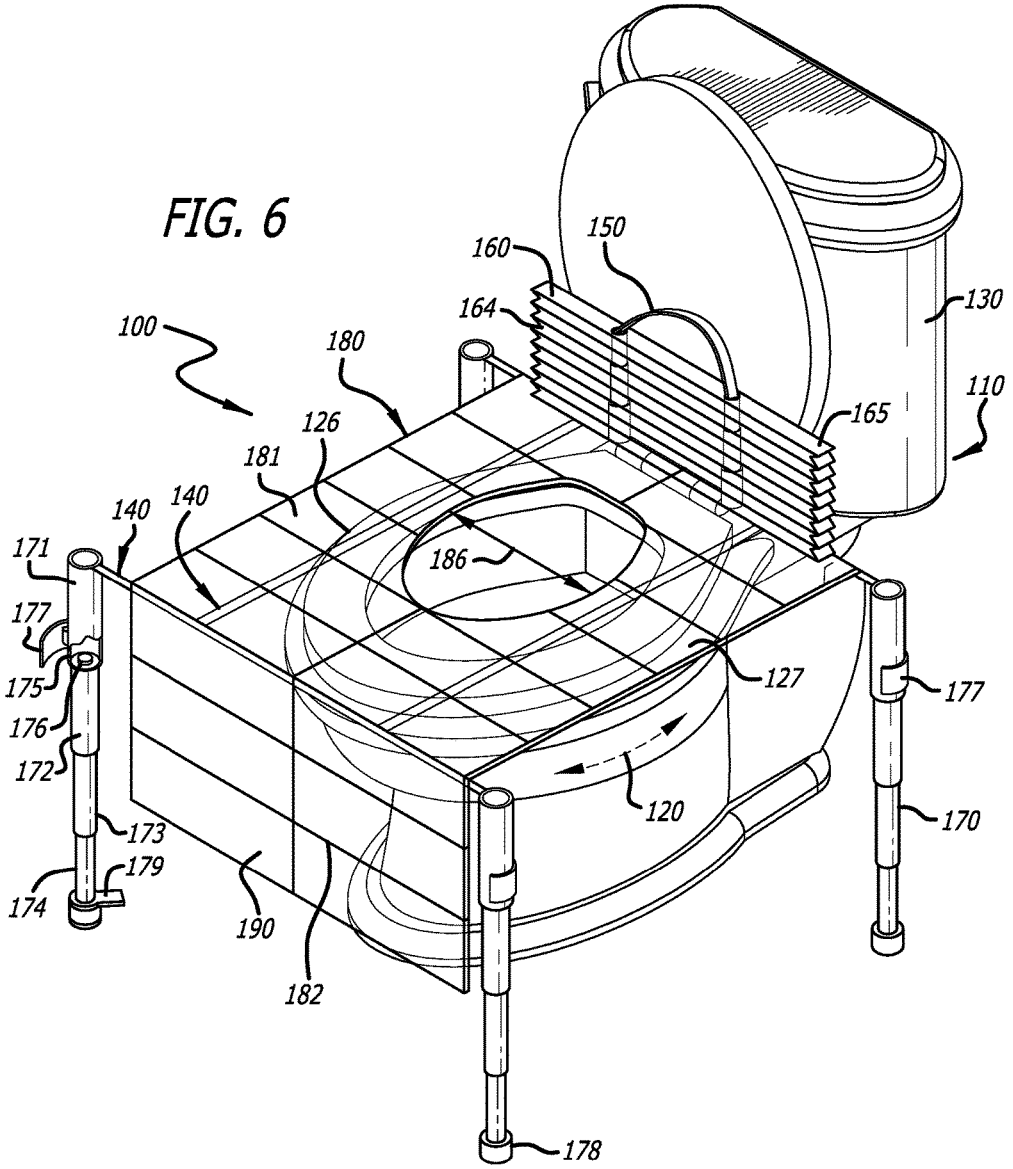
FIG. 6 is a front perspective view of the assembly of FIG. 3, but showing the backrest barrier/shield deployed to its full width, as illustrated by the top perspective view of the barrier/shield shown in FIG. 5. This assembly also includes tabs attached to the leg caps, and an adjustable and lockable pressure latch on the outermost section of each telescoping leg support with the latch at the front left leg illustrated in the unlocked position. This figure additionally includes a "cutaway" look into the outermost section of the telescoping leg to show the position of the release/retract button, which is on the top of the second outermost section of each telescoping leg, and to show that when the legs are deployed to their maximum length (height), this button will not be visible and the top of the outermost section is open so as to allow for this button to protrude when the legs are once again retracted.
Figure 12:
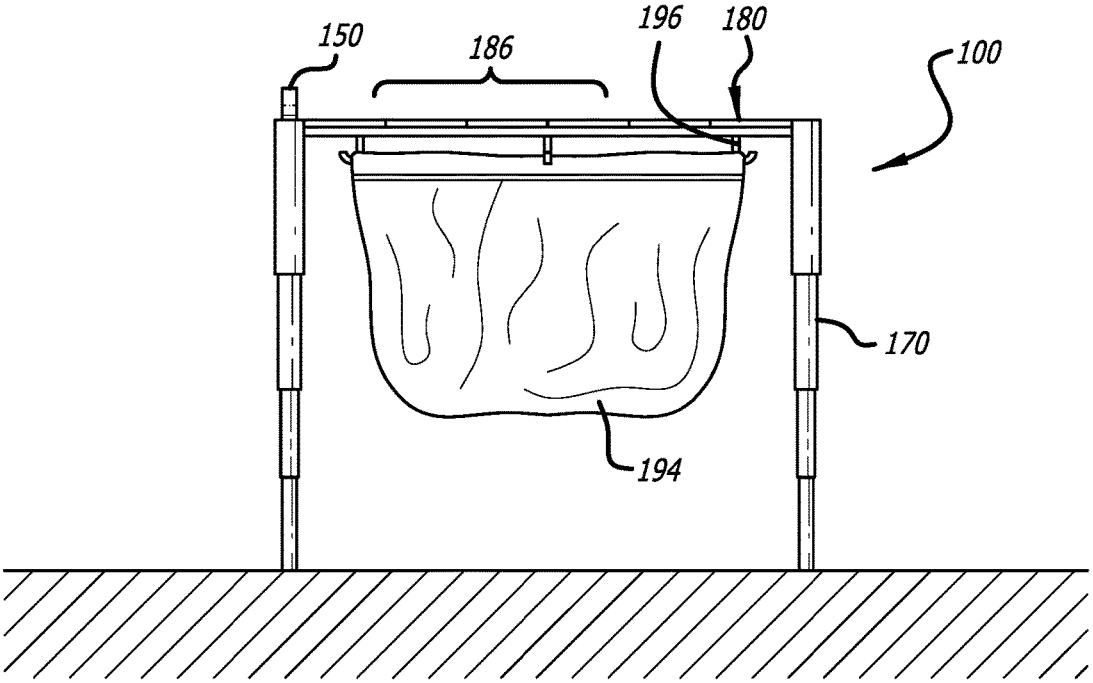
FIG. 12 is a view similar to that of FIG. 11 but showing an alternative embodiment which instead of being positioned over a toilet has a human waste collection bag removably attached underneath.

The fold-out seating surface assembly is shown generally at 180 in FIGS. 6 and 8, for example. Assembly 180 can be composed of a series of generally rectangular panels 181 sealed within a plastic or rubber-like material, one that can be easily cleaned. This construction allows for the plastic or rubber-like material to form "seams" 182 between adjacent panels so that they can be folded up/stacked (to minimize surface area while in a transportable (and storage) mode) while still being connected as a "single piece or unit," then unfolded to form a larger surface area for seating use. When unfolded, half of these panels form the left side (panel) of a seating surface 183 and half form the right side seating surface 184 (so that each panel is half the width of the total seating surface), as shown for example in FIGS. 16 and 17. These two "sides" of the panels can be connected via a single longitudinal "seam" 185 (FIG. 8). When unfolded down the length of the toilet, the panels vary in length and shape so that a center opening 186 (e.g., FIGS. 1, 2 and 8) is formed in the middle of the seating surface 184, thereby making the toilet bowl 120 (or for example bag 194 releasably held by hooks 196 as shown in FIG. 12) therebeneath available to a user. (There are no connecting longitudinal seams on the portions of the panels that form the opening 186, according to an embodiment herein.) Each "side" set of panels 183, 184 unfolds longitudinally down the length of the toilet area, with these panels being attached to one another via lateral seams 182.

Figure 13:
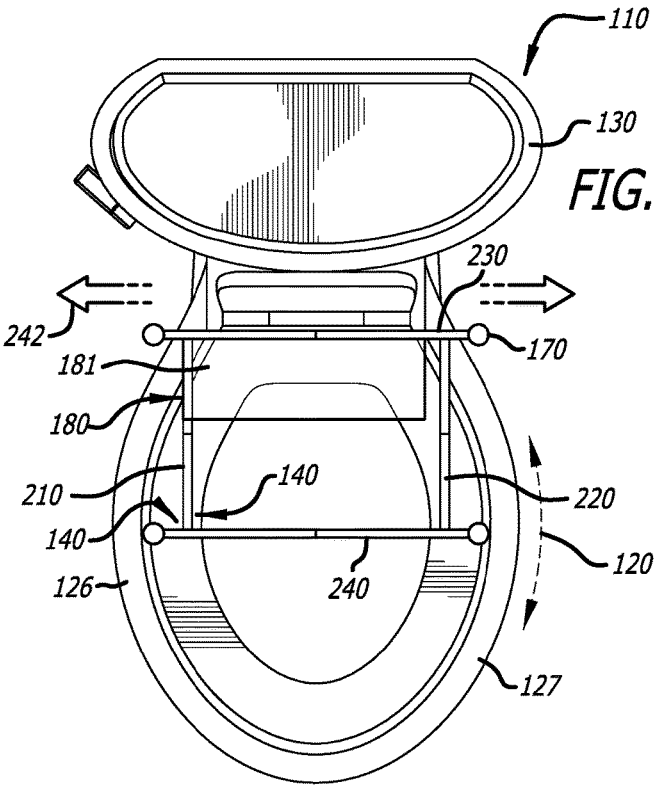
FIG. 13 is a top perspective view of a toilet seat assembly of the present disclosure (e.g., FIG. 11) shown being converted from a compact transportable mode to a deployed expanded mode. The backmost lateral support of the frame is shown by the arrows being expanded across the width of an underlying toilet.
Figure 30:
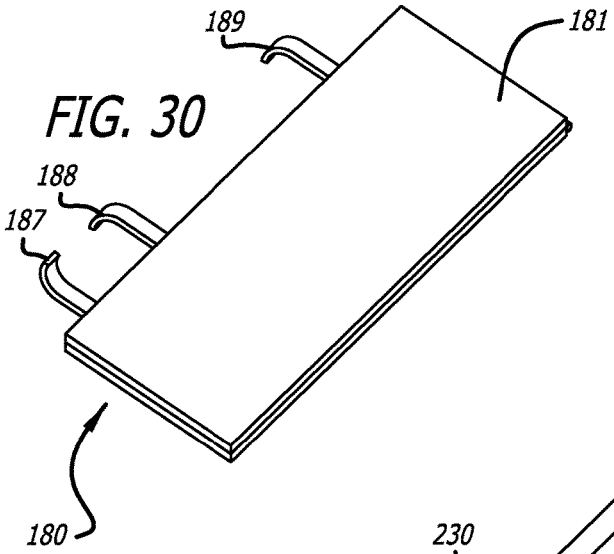
FIG. 30 is an enlarged perspective view showing the hook-like fixtures attached to the panels of the fold-out seating surface assembly to be used to securely position the seat on the frame.
Figure 31:
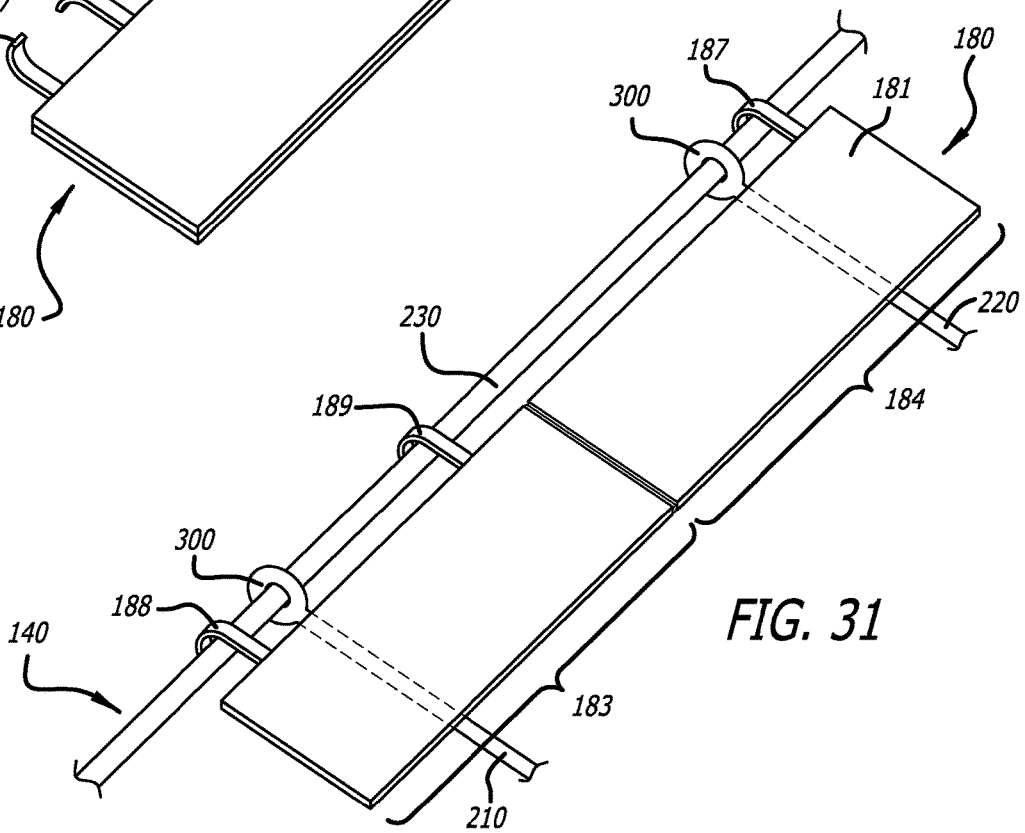
FIG. 31 shows the stacked panels of the fold-out seating surface having been folded out once across the width of the toilet and in their operative position with the panels resting on the longitudinal supports, and the hook-like fixtures resting on the lateral support to hold the seat securely in this position. The hook-like fixture that is facing upward in FIG. 30 is now facing downward and toward the frame.
Figure 32:
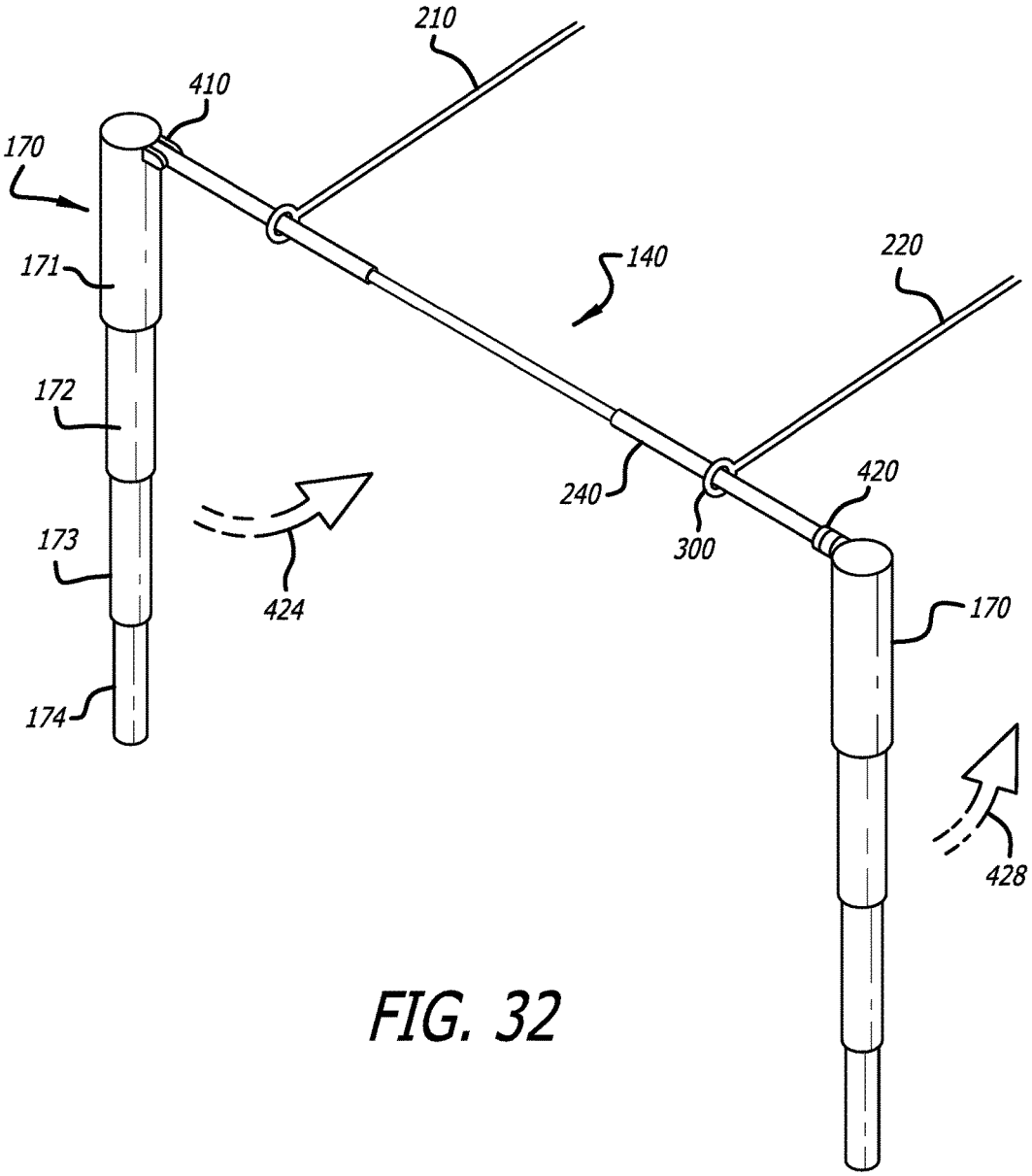
FIG. 32 shows with arrows the rotational direction of the hinges attaching the support legs to the frame. As such, when in a compact transportable mode, the legs are rotated up so that each leg will be parallel with one of the frame supports (as shown in FIG. 27, for example).

When in the compact, transportable mode as shown in FIGS. 13 and 20, the folded seat is as wide as a single panel 181 (half the width of the expanded seating surface), as long as a single panel 181, and as tall (thick) as all the panels stacked together. Referring to FIGS. 30 and 31, the panels can be connected to the frame at the back lateral support 230 by "hook-like" fixtures 187, 188, 189 that allow them to snap or hook onto and rest on the back lateral support 230. Instead of hook-like fixtures, a snap-on mechanism or other mechanisms which are apparent to those skilled in the art from this disclosure can be used.

In both the compact transportable mode and the deployed expanded mode, the hook-like fixtures 188, 189 are facing downward, toward the back lateral support 230. When the seat assembly 180 is in its compact transportable mode, the hook-like fixture 187 is facing upward (see FIG. 30). However when the two sides of the seating surface 183, 184 are unfolded across the width of the toilet, the hook-like fixture 187 faces downward so that it rests on the back lateral support 230.

Figure 18:
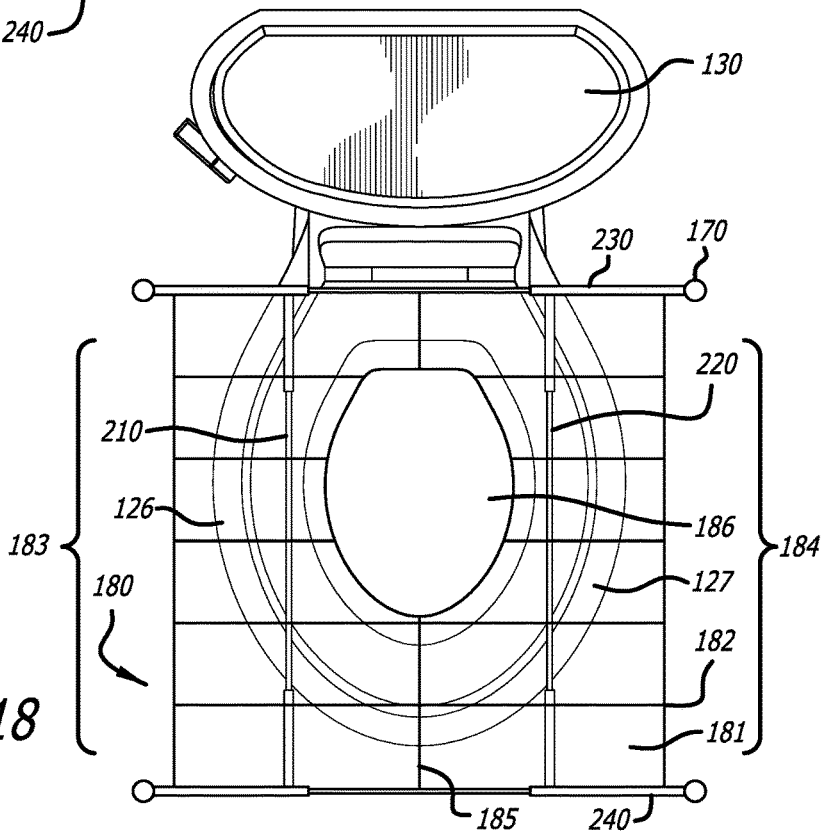
FIG. 18 is a view similar to FIG. 17 showing the seating surface fully deployed, having been folded out across the width of the toilet and then down the length of the toilet (as indicated by the arrows in FIGS. 16 and 17) or having been folded out down the length of the toilet and then across the width of the toilet (as indicated by the process of FIGS. 16 and 17), with the panels resting on top of the frame's longitudinal supports, the opening positioned over the opening of the toilet bowl, and any additional length of the fold-out seating surface extended over the forwardmost lateral support toward the floor.
Figure 33:
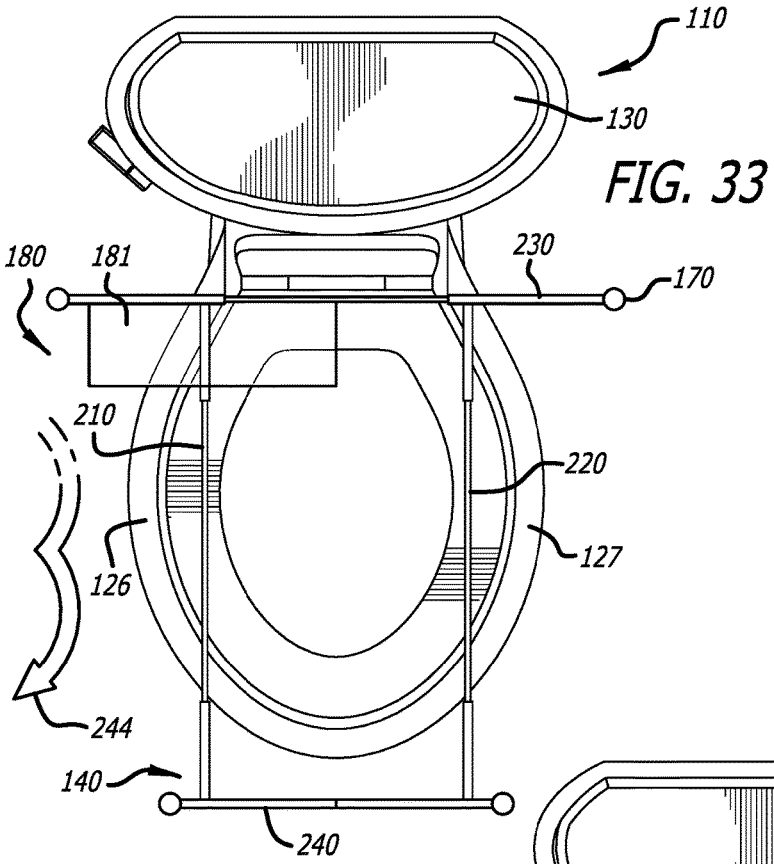
FIG. 33 is a view similar to FIG. 15 but showing an alternative assembly embodiment being converted from a compact transportable mode to an expanded operable mode wherein the paneled seat assembly unfolds lengthwise as shown by the arrow and then widthwise.
Figure 34:
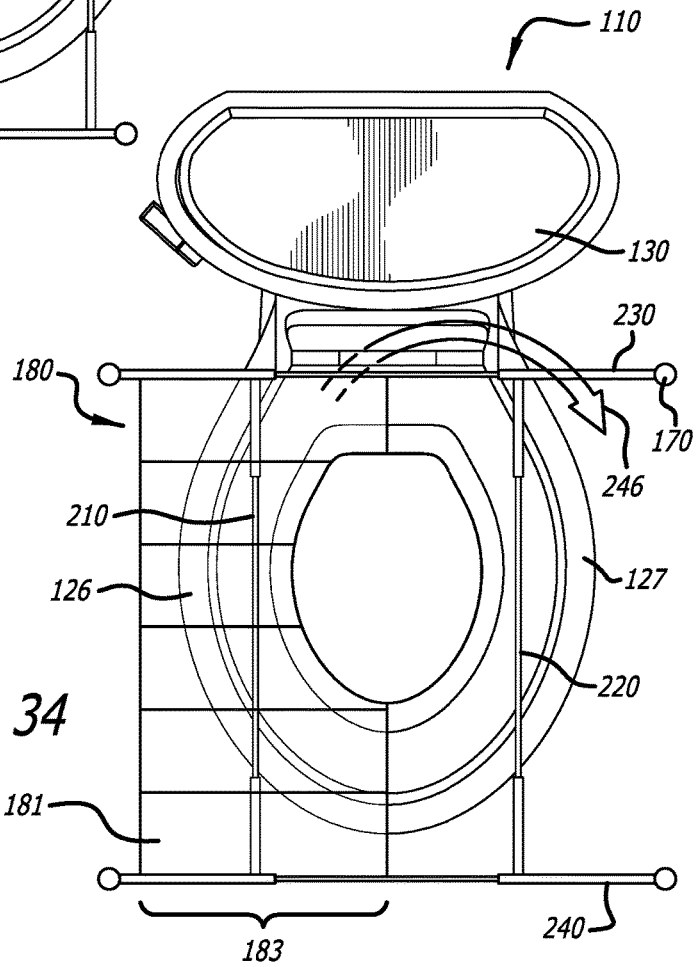
FIG. 34 is a view of the embodiment of FIG. 33 showing the paneled seat assembly unfolded lengthwise and with the subsequent widthwise unfolding being indicated by the arrow.

Once the frame 140 is expanded to its desired size, the seat surface assembly 180 can be unfolded. Pursuant to one embodiment, a user can first unfold the seating surface 180 laterally (arrow 234), thereby making it the full width (as shown in FIG. 17), then unfold (arrow 238) the panels down the length of the toilet so that they rest upon the longitudinal support bars 210, 220 of the frame (as shown in FIG. 18), arriving at the fully deployed seating surface as depicted in FIG. 8. Alternatively, a user may first unfold (arrow 244 in FIG. 33) the panels down the length of the toilet (as shown in FIG. 34) and then unfold (arrow 246) once across the width of the toilet (as shown in FIG. 34) to arrive at the fully deployed seating surface.

The seating surface assembly 180 may include a sufficient number of additional panels 190 (as shown in FIG. 6) so that one or more rows of the panels 190 can be unfolded over the foremost lateral support bar 240 and depend/hang downward toward the ground as shown by reference numeral 254. As such, this additional length 190 of hanging seating surface 254 forms a barrier between the user and the underlying hardware toilet 110. The seating surface 190 that drapes over the front support bar 240 (FIGS. 1, 6 and 10) can also provide a comfortable contact surface for the backs of the legs of a user seated on the seating surface and further protect the user from unsanitary contact or splashing.

Figure 35:
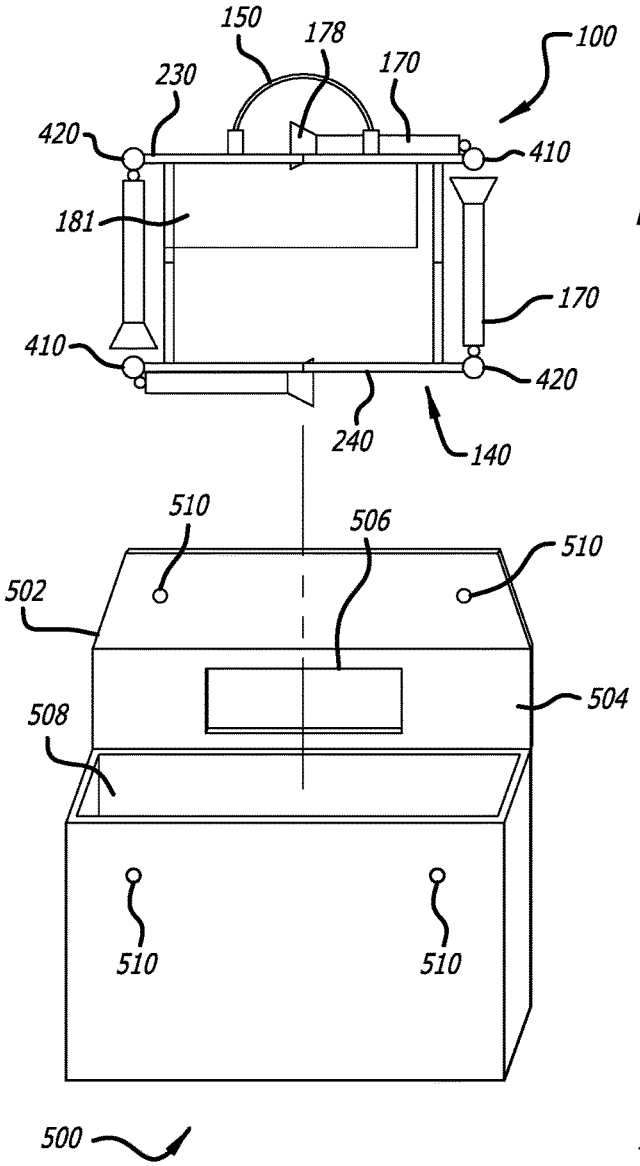
FIG. 35 is a perspective view showing the compact transportable assembly of FIG. 19, for example, being inserted into an open carrying case of the present disclosure.
Figure 36:
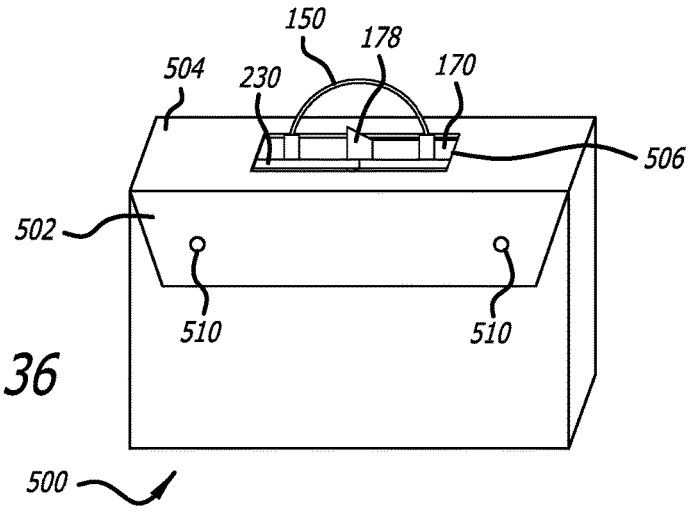
FIG. 36 is a perspective view showing the assembly in place in the carrying case illustrated in FIG. 35 and with the case lid closed and the assembly handle exposed for easy carrying of the case.

When in the compact transportable mode the assembly 100, 100*a* can be easily carried by its handle 150, as shown in FIG. 19. It is also within the scope of the disclosure to provide a carrying case for the assembly, as depicted in FIGS. 35 and 36 at 500. Case 500 can include sidewalls and a floor defining a case interior 508. A case top 504 has a through-opening 506 and a front flap 502. To insert the compact assembly 100 (or 100*a*) into the interior 508 (and to remove it from the interior) the top 504 is in an open position as shown in FIG. 35. With the compact assembly 100 (or 100*a*) inserted into the interior 508 of the case, the top 504 is closed with the handle 150 extending up through the opening 506 and the flap 502 snapped closed by mating snaps 510. Other types of releasable attaching means, aside from snaps and such as Velcro, are within the scope of this disclosure. The assembly 100 is thereby protectively and discreetly enclosed in the carrying case 500, and the case with assembly 100 therein can be easily handled and transported by a user grasping the exposed handle 150.

Thus, disclosed herein according to one definition is a collapsible and expandable toilet seating assembly that can include a seat support frame, four length-adjustable legs, a seat assembly and a backrest. The seat support frame can include front and rear extendible/collapsible lateral supports and first and second extendible/collapsible longitudinal supports connected together to form a rectangular frame. Each of the legs is connected to the support frame and is positionable in a storage positions lying generally in a plane of the frame and in alternative operative positions perpendicular to the plane. The seat assembly can include a plurality of rows and columns of panels, foldable out from a storage configuration to an operative configuration to form a seat surface supported by and connected to the frame and having a central toilet opening. The backrest is connected to the rear support and reconfigurable and repositionable between a compact condition and an expanded operable position generally perpendicular to the plane.

It is also within the scope of the present disclosure for the toilet seating assembly to include bracing for the legs. When the assembly is in its transportable compact mode the braces can be separate components, not attached to the legs or any of the other components. They still can be packaged with or within the rest of the assembly, however. Alternatively, the braces can be attached to one or more of the other components, e.g., legs, and fold up or into them, when in the compact mode. The braces can telescope or fold out to the desired lengths when the assembly is in a deployed mode. They can attach at opposite brace ends to respective legs using clamps, for example. When attached in operative positions to and extending between the legs they can be disposed at an angle to the legs or they can be perpendicular to the legs.

Although the present inventions have been described in terms of preferred and alternative embodiments above, numerous modifications and/or additions to the above-described embodiments would be readily apparent to one skilled in the art. The embodiments can be defined as methods of use or assembly (or disassembly) carried out by anyone, any subset of or all of the components and/or users; as systems of one or more components in a certain structural and/or functional relationship; and/or as subassemblies or sub-methods. The inventions can include each of the individual components separately, or subassemblies thereof. However, it is intended that the scope of the present inventions extend to all such modifications and/or additions and that the scopes of the present inventions are limited solely by the claims set forth herein.

Individual elements or features of a particular aspect of the present teachings are generally not limited to that particular aspect, but, where applicable, are interchangeable and can be used in other aspects, even if not specifically shown or described. The same may also be varied in many ways. Such variations are not to be regarded as a departure from the present teachings, and all such modifications are intended to be included within the scope of the present teachings.

The terminology used herein is for the purpose of describing particular example embodiments only and is not intended to be limiting. As used herein, the singular forms "a," "an" and "the" may be intended to include the plural forms as well, unless the context clearly indicates otherwise. The terms "comprises," "comprising," "including" and "having" are inclusive and therefore specify the presence of stated features, integers, steps, operations, elements and/or components, but do not preclude the presence or addition of one or more other features, integers, steps, operations, elements, components and/or groups thereof. The method steps, processes and operations described herein are not to be construed as necessarily requiring their performance in the particular order discussed or illustrated, unless specifically identified as an order of performance. It is also to be understood that additional or alternative steps may be employed.

Although the terms first, second, third and so forth may be used herein to describe various elements, components, regions, layers and/or sections, these elements, components, regions, layers and/or sections should not be limited by these terms. These terms may be used to distinguish one element, component, region, layer or section from another region, layer or section. Terms such as "first," "second" and other numerical terms when used herein do not imply a sequence or order unless clearly indicated by the context. Thus, a first element, component, region, layer or section discussed below can be termed a second element, component, region, layer or section without departing from the aspects of the present teachings.

When an element or layer is referred to as being "on," "engaged to," "connected to" or "coupled to" another element or layer, it may be directly on, engaged, connected or coupled to the other element or layer, or intervening elements or layers may be present. In contrast, when an element is referred to as being "directly on," "directly engaged to," "directly connected to" or "directly coupled to" another element or layer, there may be no intervening elements or layers present. Other words used to describe the relationship between elements should be interpreted in a like fashion (such as "between" versus "directly between," and "adjacent" versus "directly adjacent"). As used herein, the term "and/or" includes any and all combinations of one or more of the associated listed items.

Spatially relative terms, such as "inner," "outer," "beneath," "below," "lower," "upper," "above," "forward," "rearward," "front" and "back" may be used herein for ease of description to describe one element's or feature's relationship to another, but the disclosure is intended to encompass different orientations of the assembly in use or operation in addition to the orientation depicted in the figures. For example, if the assembly in the figures is turned over, elements described as "below" or "beneath" other elements or features would then be oriented "above" the other elements or features. Thus, the example term "below" can encompass both an orientation of above and below. The assembly may be otherwise oriented (rotated ninety degrees or at other orientations) and the spatially relative descriptors used herein interpreted accordingly.

What is claimed is:

1. A collapsible and expandable toilet seating assembly, comprising:

a frame configurable between collapsed and expanded modes;

legs configurable between collapsed and expanded modes;

a toilet seating surface assembly including a plurality of interconnected panels that are configurable between a folded-out expanded mode to form a seat surface that has a central toilet seat opening and a folded-together collapsed mode;

the seating surface assembly when in the folded-out expanded mode being adapted to be operatively supported on the frame in the expanded mode and with the legs in the expanded mode connected to and depending down from the frame;

the frame including first and second expandable lateral rods and first and second expandable longitudinal rods;

the lateral rods and the longitudinal rods forming a first rectangle when the frame is in the expanded mode and a second rectangle when the frame is in the collapsed mode;

the first rectangle being longer and wider than the second rectangle; and the legs including a first leg whose upper end is pivotally attached to a first end of the first lateral rod, a second leg whose upper end is pivotally attached to an opposite second end of the first lateral rod, a third leg whose upper end is pivotally attached to a first end of the second lateral rod, and a fourth leg whose upper end is pivotally attached to an opposite second end of the second lateral rod.

2. The toilet seating assembly of claim 1 further comprising a handle pivotally attached to a rear of the frame and pivotal between a toilet-seat-assembly carrying position lying generally in a plane of the frame and a support position disposed generally perpendicular to and extending up from the frame.

3. The toilet seating assembly of claim 1 wherein the seating surface assembly includes hooks which releasably attach the interconnected panels to the frame.

4. The toilet seating assembly of claim 1 wherein the interconnected panels are connected in rows and columns.

5. The toilet seating assembly of claim 4 wherein the interconnected panels include at least one forward row of panels that drapes downwardly over a front of the frame when the seating surface assembly is expanded and operatively supported on the frame.

6. The toilet seating assembly of claim 4 wherein the interconnected panels are configured to fold out longitudinally and then laterally to the expanded mode.

7. The toilet seating assembly of claim 4 wherein the interconnected panels are configured to fold out laterally and then longitudinally to the expanded mode.

8. A collapsible and expandable toilet seating assembly, comprising:

a frame including lateral and longitudinal rods that are configurable between a compact transport mode and a bi-directionally expanded operable mode;

a plurality of legs each attached at a respective end thereof to the frame and configurable between (a) a compact transport mode lying generally in a plane of the frame and adjacent and parallel to a different respective one of the rods and (b) an extended operable mode wherein each of the legs is pivoted to be perpendicular to the plane;

a toilet seating surface assembly configurable in a collapsed mode and an alternative expanded mode having a seat surface that has a toilet seat opening;

the seat surface being supported on the frame with the frame in the expanded operable mode; and ends of the longitudinal rods having fixtures through which the lateral rods can slidably pass.

9. The toilet seating assembly of claim 8 further comprising a handle attached to a rear of the frame and positionable between a toilet-seat-assembly carrying position lying generally in a plane of the frame and a support position disposed generally perpendicular to the plane and extending up from the frame.

10. The toilet seating assembly of claim 8 wherein the frame is configured so that the lateral rods are expanded to different lengths when the frame is in the operable mode.

11. The toilet seating assembly of claim 8 wherein the seating surface assembly includes a foldable array of panels attachable to the frame.

12. A collapsible and expandable toilet seating assembly, comprising:

the toilet seating assembly being positionable in an operative expanded mode and in an alternative transportable compact mode;

a support frame configurable in alternative bi-directionally expanded and bi-directionally collapsed configurations;

the support frame generally defining a rectangle when in the collapsed configuration and when in the expanded configuration;

four legs connected to the support frame, and positionable in alternative collapsed and at least partially extended configurations;

a toilet seating surface assembly positionable in alternative operative and compact configurations;

the seating surface assembly when in the operative configuration having a central toilet seat through-opening, and being adapted to being supported on the support frame when in the expanded configuration; and the toilet seating assembly when in the compact mode including:

the support frame being in the collapsed configuration; the legs being in the collapsed configurations; the seating surface assembly being in the compact configuration and connected to the support frame, positioned within the collapsed configuration rectangle and lying in a plane of the collapsed configuration rectangle; each of the collapsed legs being adjacent and generally parallel to a respective side of the collapsed configuration rectangle; and the support frame, the legs and the seating surface assembly forming a compact unit.

13. The toilet seating assembly of claim 12 wherein the toilet seating assembly when in the expanded mode includes the support frame being in the expanded configuration, the support frame being in the expanded configuration, the legs being in the extended configuration and the seating surface being in the operative configuration and supported on the support frame.

14. The toilet seating assembly of claim 12 further comprising a handle which is pivotally connected to a rear of the frame and pivotal between a toilet-seat-assembly carrying position lying generally in a plane of the frame and a support position disposed generally perpendicular to the plane and extending up from the frame.

15. The toilet seating assembly of claim 12 further comprising a carrying case having a top flap with a slot opening, the compact unit being positionable in the case in an enclosed carrying compartment of the case with the flap closed and a handle of the toilet seating assembly extending up through the slot to an operative carrying position.

16. The toilet seating assembly of claim 12 wherein the support frame includes a pair of extendible lateral rods and a pair of extendible longitudinal rods wherein the longitudinal rods are connected to the lateral rods so as to be able to slide along the lateral rods to adjust the distance between the longitudinal rods.

17. The toilet seating assembly of claim 1 wherein the seat surface forms a toilet seat.

18. The toilet seating assembly of claim 8 wherein the seat surface forms a toilet seat.

19. The toilet seating assembly of claim 15 wherein the case is configured to be separated and spaced from the frame, the legs and the toilet seating surface assembly when all are collapsed.

20. The toilet seating assembly of claim 8 wherein the longitudinal rods are slidable along at least a portion of a length of the lateral rods to position the longitudinal rods relative to the lateral rods.

21. The toilet seating assembly of claim 8 wherein the seat surface forms a toilet seat.

22. The toilet seating assembly of claim 8 wherein the fixtures are eyelets.

23. The toilet seating assembly of claim 12 wherein the seating surface assembly forms a toilet seat.

24. The toilet seating assembly of claim 1 wherein the frame is configured such that end portions of both ends of both of the lateral rods extend out from adjacent ends of an adjacent one of the longitudinal rods of the first rectangle when the frame is in the expanded mode.

25. The toilet seating assembly of claim 1 wherein the frame is configured so that the lateral rods are independently expandable so that one can be longer than the other when the frame is in the operable mode with the longitudinal rods being the same length as each other.

26. The toilet seating assembly of claim 1 wherein the frame is configured so that when the legs are in the collapsed mode each of the legs is adjacent and parallel to a respective one of the rods.

27. The toilet seating assembly of claim 8 wherein (a) the lateral rods include first and second lateral rods and the longitudinal rods include first and second longitudinal rods, and (b) the plurality of legs includes a first leg whose upper end is pivotally attached to a first end of the first lateral rod, a second leg whose upper end is pivotally attached to an opposite second end of the first lateral rod, a third leg whose upper end is pivotally attached to a first end of the second lateral rod, and a fourth leg whose upper end is pivotally attached to an opposite second end of the second lateral rod.

28. The toilet seating assembly of claim 8 wherein the frame is configured so that the lateral rods are independently expandable so that one can be longer than the other when the frame is in the operable mode with the longitudinal rods being the same length as each other.

29. The toilet seating assembly of claim 8 further comprising a handle attached to the rearwardmost of the lateral rods and a case configured to receive therein the toilet seating assembly when in the collapsed mode and with the handle extending out of a slot of the case and into a carrying position.

30. The toilet seating assembly of claim 12 further comprising a carrying handle connected to the support frame and when the toilet seating assembly is in the compact mode, the handle being configured for carrying the compact unit in a hanging down position.

31. The toilet seating assembly of claim 30 further comprising a case configured to receive therein the toilet seating assembly when in the compact mode and with the handle extending out of a slot of the case and into a carrying position.

32. The toilet seating assembly of claim 12 wherein the support frame includes first and second extendible lateral rods and first and second extendible longitudinal rods.

33. The toilet seating assembly of claim 32 wherein the frame is configured so that the lateral rods are independently expandable so that one can be longer than the other when the frame is in the operable mode with the longitudinal rods being the same length as each other.

34. The toilet seating assembly of claim 32 wherein eyelet ends of the longitudinal rods are slidable along at least a portion of a length of the lateral rods to position the longitudinal rods relative to the lateral rods.

35. The toilet seating assembly of claim 12 wherein the seating surface assembly includes at least one hook which releasably attaches the interconnected panels to the frame.

36. A collapsible and expandable toilet seating assembly, comprising:

the toilet seating assembly being positionable in an operative expanded mode and in an alternative transportable compact mode;

a support frame configurable in alternative bi-directionally expanded and bi-directionally collapsed configurations;

the support frame generally defining a rectangle when in the collapsed configuration and when in the expanded configuration;

a carrying handle connected to the support frame;

four legs connected to the support frame, and positionable in alternative collapsed and at least partially extended configurations;

a toilet seating surface assembly positionable in alternative operative and compact configurations;

the seating surface assembly when in the operative configuration having a central toilet seat through-opening, and being adapted to being supported by the support frame when in the expanded configuration;

the toilet seating assembly when in the compact mode including:

the support frame being in the collapsed configuration; the legs being in the collapsed configurations; the seating surface assembly being in the compact configuration; each of the collapsed legs being adjacent and generally parallel to a respective side of the rectangle; the seating surface assembly being in a compact configuration; and the support frame, the legs and the seating surface assembly forming a compact unit to which the handle is connected for carrying the compact unit; and the support frame including a pair of extendible lateral rods and a pair of extendible longitudinal rods and the longitudinal rods being connected to the lateral rods so as to be able to slide along the lateral rods to adjust the distance between the longitudinal rods.

37. The toilet seating assembly of claim 36 wherein:

the seating surface assembly includes a plurality of interconnected panels that are configurable between a folded-out expanded mode to form a seat surface that has a central toilet seat opening and a folded-together collapsed mode;

the seating surface assembly when in the folded-out expanded mode is adapted to be operatively supported on the frame in the expanded configuration and with the legs in the extended configuration depending down from the frame;

the interconnected panels are connected in rows and columns; and the interconnected panels include at least one forward row of panels that drapes downwardly over a front of the frame when the seating surface assembly is expanded and operatively supported on the frame.

38. The toilet seating assembly of claim 36 wherein the frame is configured so that the lateral rods are independently expandable so that one can be longer than the other when the toilet seating assembly is in the expanded mode with the longitudinal rods being the same length as each other.

39. A collapsible and expandable toilet seating assembly, comprising:

a frame configurable between collapsed and expanded modes;

legs configurable between collapsed and expanded modes;

a toilet seating surface assembly including a plurality of interconnected panels that are configurable between a folded-out expanded mode to form a seat surface that has a central toilet seat opening and a folded-together collapsed mode;

the seating surface assembly when in the folded-out expanded mode being adapted to be operatively supported on the frame in the expanded mode and with the legs in the expanded mode connected to and depending down from the frame;

the interconnected panels being connected in rows and columns; and the interconnected panels including at least one forward row of panels that drapes downwardly over a front of the frame when the seating surface assembly is expanded and operatively supported on the frame.

40. The toilet seating assembly of claim 39 wherein the interconnected panels are configured to fold out longitudinally and then laterally to the expanded mode.

41. The toilet seating assembly of claim 39 wherein the interconnected panels are configured to fold out laterally and then longitudinally to the expanded mode.

42. The toilet seating assembly of claim 39 wherein the frame includes extendible lateral rods and extendible longitudinal rods.

43. The toilet seating assembly of claim 42 wherein the frame is configured so that the lateral rods are independently expandable so that one can be longer than the other when the frame is in the operable mode with the longitudinal rods being the same length as each other.

44. A collapsible and expandable toilet seating assembly, comprising:

a frame including first and second bidirectionally-expandable lateral rods and first and second bidirectionally-expandable longitudinal rods;

the frame being configurable between a compact transport mode and an expanded operable mode;

first, second, third and fourth legs, each attached at a respective end thereof to the frame and configurable between (a) a compact transport mode adjacent and parallel to a different respective one of the rods and (b) an extended operable mode wherein each of the legs is pivoted to be perpendicular to a plane of the frame;

a first hinge directly attaching a first end of the first lateral rod to the first leg configured for pivotable movement between an upright position and a first storage position adjacent to and parallel to a first one of the rods;

a second hinge directly attaching an opposite second end of the first lateral rod to the second leg configured for pivotable movement between an upright position and a second storage position adjacent to and parallel to a second one of the rods;

a third hinge directly attaching a first end of the second lateral rod to the third leg configured for pivotable movement between an upright position and a third storage position adjacent to and parallel to a third one of the rods;

a fourth hinge directly attaching an opposite second end of the second lateral rod to the fourth leg configured for pivotable movement between an upright position and a fourth storage position adjacent to and parallel to a fourth one of the rods;

a toilet seating surface assembly configurable in a collapsed mode and an alternative expanded mode having a seat surface that has a toilet seat opening; and the seat surface being supported on the frame with the frame in the expanded operable mode.

45. The toilet seating assembly of claim 44 wherein the frame is configured so that the lateral rods are independently expandable so that one can be longer than the other when the frame is in the operable mode with the longitudinal rods being the same length as each other.

46. The toilet seating assembly of claim 44 wherein two of the first, second, third and fourth storage positions are in the plane of the frame.

47. The toilet seating assembly of claim 46 wherein one of the two storage positions is adjacent the first lateral rod and the other of the two storage positions is adjacent the second lateral rod.

48. The toilet seating assembly of claim 47 wherein one of the storage positions is adjacent, parallel and under the first lateral rod and another one of the storage positions is adjacent, parallel and under the second lateral rod.

49. The toilet seating assembly of claim 44 wherein the first, second, third and fourth hinges are directly attached to sides of the first, second, third and fourth legs, respectively.

50. The toilet seating assembly of claim 44 wherein the longitudinal rods are connected to the lateral rods so as to be able to slide along the lateral rods to adjust the position of at least one of the longitudinal rods relative to the lateral rods or to the other longitudinal rod.

51. The toilet seating assembly of claim 44 further comprising a handle attached to one of the lateral rods and a case configured to receive therein the toilet seating assembly when in a collapsed mode and with the handle extending out of a slot of the case and into a carrying position.

52. A collapsible and expandable toilet seating assembly, comprising:

a frame configurable between collapsed and expanded modes;

legs configurable between collapsed and expanded modes;

a toilet seating surface assembly configurable between an expanded mode to form a seat surface that has a central toilet seat opening and a compact mode;

the seating surface assembly when in the expanded mode being adapted to be operatively supported on the frame when also in the expanded mode with the legs in the expanded mode and connected to and depending down from the frame;

a back shield assembly connected to a back of the frame and positionable in a compact transport position and an alternative operative extended position extending up from the frame; and the back shield assembly having a back-and-forth folded accordion construction forming a user contact surface and telescopable support rods passing through the accordion construction and configured to help reposition the contact surface between transport and extended positions.

53. The toilet seating assembly of claim 52 wherein the back shield assembly includes a top handle attached at opposite ends thereof to the support rods and graspable by a user to reposition the back shield assembly between the transport and extended positions.

54. The toilet seating assembly of claim 53 further comprising a case configured to receive therein the toilet seating assembly when in a collapsed mode and with the handle extending out of a slot of the case and into a carrying position.

55. The toilet seating assembly of claim 53 wherein the top handle attached is positionable in a first position extending up from the rods and an alternative second position generally perpendicular to the first position.

56. The toilet seating assembly of claim 52 wherein the accordion construction forms a central panel and the back shield assembly includes opposite side panels connected to the central panel and positionable so as to extend out from opposite sides of the central panel and lying generally in the same plane as the central panel.

57. The toilet seating assembly of claim 56 wherein the side panels are configured to be positionable by swinging the side panels about vertical pivot axes.

58. The toilet seating assembly of claim 56 wherein the side panels are configured to be positionable by sliding the side panels laterally out in opposite directions from the central panel.

59. The toilet seating assembly of claim 52 wherein the frame includes a pair of longitudinal rods and a pair of lateral rods, and the longitudinal rods are connected to the lateral rods so as to be able to slide along the lateral rods to adjust the position of at least one of the longitudinal rods relative to the lateral rods or to the other longitudinal rod.

* * * * *